US007285155B2

(12) United States Patent
Taylor et al.

(10) Patent No.: US 7,285,155 B2
(45) Date of Patent: Oct. 23, 2007

(54) AIR CONDITIONER DEVICE WITH ENHANCED ION OUTPUT PRODUCTION FEATURES

(76) Inventors: Charles E. Taylor, 2719 St. Thomas Dr., Punta Gorda, FL (US) 33950; Andrew J. Parker, 261 Montego Key, Novato, CA (US) 94949; Igor Y. Botvinnik, 650 Davis St., San Francisco, CA (US) 94111; Shek Fai Lau, 137 Beach Park Blvd., Foster City, CA (US) 94104; Gregory S. Snyder, 650 Davis St., San Francisco, CA (US) 94111; John Paul Reeves, 650 Davis St., San Francisco, CA (US) 94111

( * ) Notice: Subject to any disclaimer, the term of this patent is extended or adjusted under 35 U.S.C. 154(b) by 136 days.

(21) Appl. No.: 11/091,243

(22) Filed: Mar. 28, 2005

(65) Prior Publication Data

US 2006/0016337 A1 Jan. 26, 2006

Related U.S. Application Data

(63) Continuation-in-part of application No. 11/003,671, filed on Dec. 3, 2004.

(60) Provisional application No. 60/590,735, filed on Jul. 23, 2004.

(51) Int. Cl.
*B03C 3/68* (2006.01)

(52) U.S. Cl. ..... 96/25; 95/81; 96/63; 96/80; 361/226; 361/235

(58) Field of Classification Search ..... 96/25, 96/30, 39–41, 51, 60, 63, 83, 84, 86, 80, 96/87, 94; 95/81; 361/225, 226, 230, 235; 323/903

See application file for complete search history.

(56) References Cited

U.S. PATENT DOCUMENTS

| | | | |
|---|---|---|---|
| 653,421 | A | 7/1900 | Lorey |
| 895,729 | A | 8/1908 | Carlborg |
| 995,958 | A | 6/1911 | Goldberg |
| 1,791,338 | A | 2/1931 | Wintermute |
| 1,869,335 | A | 7/1932 | Day |
| 1,882,949 | A | 10/1932 | Ruder |

(Continued)

FOREIGN PATENT DOCUMENTS

| | | | |
|---|---|---|---|
| CN | 2111112 | U | 7/1972 |

(Continued)

OTHER PUBLICATIONS

U.S. Appl. No. 60/104,573, filed Oct. 16, 1998, Krichtafovitch.

(Continued)

*Primary Examiner*—Richard L. Chiesa
(74) *Attorney, Agent, or Firm*—Bell, Boyd & Lloyd, LLP

(57) ABSTRACT

The present invention provides an air treatment device including a housing, an emitter electrode configured within the housing and a collector electrode configured within the housing and positioned downstream from the emitter electrode. The device preferably increases the ions produced for a start up period after the device is initially turned on, wherein the device automatically decreases ion production after the desired period. The device preferably includes a first and second voltage source to selectively increase and decrease voltages applied to the emitter and/or collector electrode to adjust the ion production. In one embodiment, the device includes a voltage controller to selectively adjust the voltage provided by the voltage source for the start up period and normal operation.

20 Claims, 9 Drawing Sheets

U.S. PATENT DOCUMENTS

| | | | |
|---|---|---|---|
| 2,129,783 | A | 9/1938 | Penney |
| 2,327,588 | A | 8/1943 | Bennett |
| 2,359,057 | A | 9/1944 | Skinner |
| 2,509,548 | A | 5/1950 | White |
| 2,590,447 | A | 3/1952 | Nord et al. |
| 2,949,550 | A | 8/1960 | Brown |
| 3,018,394 | A | 1/1962 | Brown |
| 3,026,964 | A | 3/1962 | Penney |
| 3,374,941 | A | 3/1968 | Okress |
| 3,518,462 | A | 6/1970 | Brown |
| 3,540,191 | A | 11/1970 | Herman |
| 3,581,470 | A | 6/1971 | Aitkenhead et al. |
| 3,638,058 | A | 1/1972 | Fritzius |
| 3,744,216 | A | 7/1973 | Halloran |
| 3,806,763 | A | 4/1974 | Masuda |
| 3,892,927 | A | 7/1975 | Lindenberg |
| 3,945,813 | A | 3/1976 | Iinoya et al. |
| 3,958,960 | A | 5/1976 | Bakke |
| 3,958,961 | A | 5/1976 | Bakke |
| 3,958,962 | A | 5/1976 | Hayashi |
| 3,981,695 | A | 9/1976 | Fuchs |
| 3,984,215 | A | 10/1976 | Zucker |
| 3,988,131 | A | 10/1976 | Kanazawa et al. |
| 4,007,024 | A | 2/1977 | Sallee et al. |
| 4,052,177 | A | 10/1977 | Kide |
| 4,056,372 | A | 11/1977 | Hayashi |
| 4,070,163 | A | 1/1978 | Kolb et al. |
| 4,074,983 | A | 2/1978 | Bakke |
| 4,092,134 | A | 5/1978 | Kikuchi |
| 4,097,252 | A | 6/1978 | Kirchhoff et al. |
| 4,102,654 | A | 7/1978 | Pellin |
| 4,104,042 | A | 8/1978 | Brozenick |
| 4,110,086 | A | 8/1978 | Schwab et al. |
| 4,119,415 | A | 10/1978 | Hayashi et al. |
| 4,126,434 | A | 11/1978 | Keiichi |
| 4,138,233 | A | 2/1979 | Masuda |
| 4,147,522 | A | 4/1979 | Gonas et al. |
| 4,155,792 | A | 5/1979 | Gelhaar et al. |
| 4,171,975 | A | 10/1979 | Kato et al. |
| 4,185,971 | A | 1/1980 | Isahaya |
| 4,189,308 | A | 2/1980 | Feldman |
| 4,205,969 | A | 6/1980 | Matsumoto |
| 4,209,306 | A | 6/1980 | Feldman et al. |
| 4,218,225 | A | 8/1980 | Kirchhoff et al. |
| 4,225,323 | A | 9/1980 | Zarchy et al. |
| 4,227,894 | A | 10/1980 | Proynoff |
| 4,231,766 | A | 11/1980 | Spurgin |
| 4,232,355 | A | 11/1980 | Finger et al. |
| 4,244,710 | A | 1/1981 | Burger |
| 4,244,712 | A | 1/1981 | Tongret |
| 4,251,234 | A | 2/1981 | Chang |
| 4,253,852 | A | 3/1981 | Adams |
| 4,259,093 | A | 3/1981 | Vlastos et al. |
| 4,259,452 | A | 3/1981 | Yukuta et al. |
| 4,259,707 | A | 3/1981 | Penney |
| 4,264,343 | A | 4/1981 | Natarajan et al. |
| 4,266,948 | A | 5/1981 | Teague et al. |
| 4,282,014 | A | 8/1981 | Winkler et al. |
| 4,284,420 | A | 8/1981 | Borysiak |
| 4,289,504 | A | 9/1981 | Scholes |
| 4,293,319 | A | 10/1981 | Claassen, Jr. |
| 4,308,036 | A | 12/1981 | Zahedi et al. |
| 4,315,188 | A | 2/1982 | Cerny et al. |
| 4,318,718 | A | 3/1982 | Utsumi et al. |
| 4,338,560 | A | 7/1982 | Lemley |
| 4,342,571 | A | 8/1982 | Hayashi |
| 4,349,359 | A | 9/1982 | Fitch et al. |
| 4,351,648 | A | 9/1982 | Penney |
| 4,354,861 | A | 10/1982 | Kalt |
| 4,357,150 | A | 11/1982 | Masuda et al. |
| 4,362,632 | A | 12/1982 | Jacob |
| 4,363,072 | A | 12/1982 | Coggins |
| 4,366,525 | A | 12/1982 | Baumgartner |
| 4,369,776 | A | 1/1983 | Roberts |
| 4,375,364 | A | 3/1983 | Van Hoesen et al. |
| 4,380,900 | A | 4/1983 | Linder et al. |
| 4,386,395 | A | 5/1983 | Francis, Jr. |
| 4,391,614 | A | 7/1983 | Rozmus |
| 4,394,239 | A | 7/1983 | Kitzelmann et al. |
| 4,405,342 | A | 9/1983 | Bergman |
| 4,406,671 | A | 9/1983 | Rozmus |
| 4,412,850 | A | 11/1983 | Kurata et al. |
| 4,413,225 | A | 11/1983 | Donig et al. |
| 4,414,603 | A | 11/1983 | Masuda |
| 4,435,190 | A | 3/1984 | Taillet et al. |
| 4,440,552 | A | 4/1984 | Uchiya et al. |
| 4,443,234 | A | 4/1984 | Carlsson |
| 4,445,911 | A | 5/1984 | Lind |
| 4,477,263 | A | 10/1984 | Shaver et al. |
| 4,477,268 | A | 10/1984 | Kalt |
| 4,481,017 | A | 11/1984 | Furlong |
| 4,496,375 | A | 1/1985 | Levantine |
| 4,502,002 | A | 2/1985 | Ando |
| 4,505,724 | A | 3/1985 | Baab |
| 4,509,958 | A | 4/1985 | Masuda et al. |
| 4,514,780 | A | 4/1985 | Brussee et al. |
| 4,515,982 | A | 5/1985 | Lechtken et al. |
| 4,516,991 | A | 5/1985 | Kawashima |
| 4,521,229 | A | 6/1985 | Baker et al. |
| 4,522,634 | A | 6/1985 | Frank |
| 4,534,776 | A | 8/1985 | Mammel et al. |
| 4,536,698 | A | 8/1985 | Shevalenko et al. |
| 4,544,382 | A | 10/1985 | Taillet et al. |
| 4,555,252 | A | 11/1985 | Eckstein |
| 4,569,684 | A | 2/1986 | Ibbott |
| 4,582,961 | A | 4/1986 | Frederiksen |
| 4,587,475 | A | 5/1986 | Finney, Jr. et al. |
| 4,588,423 | A | 5/1986 | Gillingham et al. |
| 4,590,042 | A | 5/1986 | Drage |
| 4,597,780 | A | 7/1986 | Reif |
| 4,597,781 | A | 7/1986 | Spector |
| 4,600,411 | A | 7/1986 | Santamaria |
| 4,601,733 | A | 7/1986 | Ordines et al. |
| 4,604,174 | A | 8/1986 | Bollinger et al. |
| 4,614,573 | A | 9/1986 | Masuda |
| 4,623,365 | A | 11/1986 | Bergman |
| 4,626,261 | A | 12/1986 | Jorgensen |
| 4,632,135 | A | 12/1986 | Lenting et al. |
| 4,632,746 | A | 12/1986 | Bergman |
| 4,636,981 | A | 1/1987 | Ogura |
| 4,643,744 | A | 2/1987 | Brooks |
| 4,643,745 | A | 2/1987 | Sakakibara et al. |
| 4,647,836 | A | 3/1987 | Olsen |
| 4,650,648 | A | 3/1987 | Beer et al. |
| 4,656,010 | A | 4/1987 | Leitzke et al. |
| 4,657,738 | A | 4/1987 | Kanter et al. |
| 4,659,342 | A | 4/1987 | Lind |
| 4,662,903 | A | 5/1987 | Yanagawa |
| 4,666,474 | A | 5/1987 | Cook |
| 4,668,479 | A | 5/1987 | Manabe et al. |
| 4,670,026 | A | 6/1987 | Hoenig |
| 4,674,003 | A | 6/1987 | Zylka |
| 4,680,496 | A | 7/1987 | Letournel et al. |
| 4,686,370 | A | 8/1987 | Blach |
| 4,689,056 | A | 8/1987 | Noguchi et al. |
| 4,691,829 | A | 9/1987 | Auer |
| 4,692,174 | A | 9/1987 | Gelfand et al. |
| 4,693,869 | A | 9/1987 | Pfaff |
| 4,694,376 | A | 9/1987 | Gesslauer |
| 4,702,752 | A | 10/1987 | Yanagawa |
| 4,713,092 | A | 12/1987 | Kikuchi et al. |
| 4,713,093 | A | 12/1987 | Hansson |
| 4,713,724 | A | 12/1987 | Voelkel |
| 4,715,870 | A | 12/1987 | Masuda et al. |

4,725,289 A 2/1988 Quintilian
4,726,812 A 2/1988 Hirth
4,726,814 A 2/1988 Weitman
4,736,127 A 4/1988 Jacobsen
4,743,275 A 5/1988 Flanagan
4,749,390 A 6/1988 Burnett et al.
4,750,921 A 6/1988 Sugita et al.
4,760,302 A 7/1988 Jacobsen
4,760,303 A 7/1988 Miyake
4,765,802 A 8/1988 Gombos et al.
4,771,361 A 9/1988 Varga
4,772,297 A 9/1988 Anzai
4,779,182 A 10/1988 Mickal et al.
4,781,736 A 11/1988 Cheney et al.
4,786,844 A 11/1988 Farrell et al.
4,789,801 A 12/1988 Lee
4,808,200 A 2/1989 Dallhammer et al.
4,811,159 A 3/1989 Foster, Jr.
4,822,381 A 4/1989 Mosley et al.
4,853,005 A 8/1989 Jaisinghani et al.
4,869,736 A 9/1989 Ivester et al.
4,892,713 A 1/1990 Newman
4,929,139 A 5/1990 Vorreiter et al.
4,940,470 A 7/1990 Jaisinghani et al.
4,940,894 A 7/1990 Morters
4,941,068 A 7/1990 Hofmann
4,941,224 A 7/1990 Saeki et al.
4,944,778 A 7/1990 Yanagawa
4,954,320 A 9/1990 Birmingham et al.
4,955,991 A 9/1990 Torok et al.
4,966,666 A 10/1990 Waltonen
4,967,119 A 10/1990 Torok et al.
4,976,752 A 12/1990 Torok et al.
4,978,372 A 12/1990 Pick
D315,598 S 3/1991 Yamamoto et al.
5,003,774 A 4/1991 Leonard
5,006,761 A 4/1991 Torok et al.
5,010,869 A 4/1991 Lee
5,012,093 A 4/1991 Shimizu
5,012,094 A 4/1991 Hamade
5,012,159 A 4/1991 Torok et al.
5,022,979 A 6/1991 Hijikata et al.
5,024,685 A 6/1991 Torok et al.
5,030,254 A 7/1991 Heyen et al.
5,034,033 A 7/1991 Alsup et al.
5,037,456 A 8/1991 Yu
5,045,095 A 9/1991 You
5,053,912 A 10/1991 Loreth et al.
5,059,219 A 10/1991 Plaks et al.
5,061,462 A 10/1991 Suzuki
5,066,313 A 11/1991 Mallory, Sr.
5,072,746 A 12/1991 Kantor
5,076,820 A 12/1991 Gurvitz
5,077,468 A 12/1991 Hamade
5,077,500 A 12/1991 Torok et al.
5,100,440 A 3/1992 Stahel et al.
RE33,927 E 5/1992 Fuzimura
D326,514 S 5/1992 Alsup et al.
5,118,942 A 6/1992 Hamade
5,125,936 A 6/1992 Johansson
5,136,461 A 8/1992 Zellweger
5,137,546 A 8/1992 Steinbacher et al.
5,141,529 A 8/1992 Oakley et al.
5,141,715 A 8/1992 Sackinger et al.
D329,284 S 9/1992 Patton
5,147,429 A 9/1992 Bartholomew et al.
5,154,733 A 10/1992 Fujii et al.
5,158,580 A 10/1992 Chang
D332,655 S 1/1993 Lytle et al.
5,180,404 A 1/1993 Loreth et al.
5,183,480 A 2/1993 Raterman et al.
5,196,171 A 3/1993 Peltier
5,198,003 A 3/1993 Haynes
5,199,257 A 4/1993 Colletta et al.
5,210,678 A 5/1993 Lain et al.
5,215,558 A 6/1993 Moon
5,217,504 A 6/1993 Johansson
5,217,511 A 6/1993 Plaks et al.
5,234,555 A 8/1993 Ibbott
5,248,324 A 9/1993 Hara
5,250,267 A 10/1993 Johnson et al.
5,254,155 A 10/1993 Mensi
5,266,004 A 11/1993 Tsumurai et al.
5,271,763 A 12/1993 Jang
5,282,891 A 2/1994 Durham
5,290,343 A 3/1994 Morita et al.
5,296,019 A 3/1994 Oakley et al.
5,302,190 A 4/1994 Williams
5,308,586 A 5/1994 Fritsche et al.
5,315,838 A 5/1994 Thompson
5,316,741 A 5/1994 Sewell et al.
5,330,559 A 7/1994 Cheney et al.
5,348,571 A 9/1994 Weber
5,376,168 A 12/1994 Inculet
5,378,978 A 1/1995 Gallo et al.
5,386,839 A 2/1995 Chen
5,395,430 A 3/1995 Lundgren et al.
5,401,301 A 3/1995 Schulmerich et al.
5,401,302 A 3/1995 Schulmerich et al.
5,403,383 A 4/1995 Jaisinghani
5,405,434 A 4/1995 Inculet
5,407,469 A 4/1995 Sun
5,407,639 A 4/1995 Watanabe et al.
5,417,936 A 5/1995 Suzuki et al.
5,419,953 A 5/1995 Chapman
5,433,772 A 7/1995 Sikora
5,435,817 A 7/1995 Davis et al.
5,435,978 A 7/1995 Yokomi
5,437,713 A 8/1995 Chang
5,437,843 A 8/1995 Kuan
5,445,798 A 8/1995 Ikeda et al.
5,466,279 A 11/1995 Hattori et al.
5,468,454 A 11/1995 Kim
5,474,599 A 12/1995 Cheney et al.
5,484,472 A 1/1996 Weinberg
5,484,473 A 1/1996 Bontempi
5,492,678 A 2/1996 Ota et al.
5,501,844 A 3/1996 Kasting, Jr. et al.
5,503,808 A 4/1996 Garbutt et al.
5,503,809 A 4/1996 Coate et al.
5,505,914 A 4/1996 Tona-Serra
5,508,008 A 4/1996 Wasser
5,514,345 A 5/1996 Garbutt et al.
5,516,493 A 5/1996 Bell et al.
5,518,531 A 5/1996 Joannu
5,520,887 A 5/1996 Shimizu et al.
5,525,310 A 6/1996 Decker et al.
5,529,613 A 6/1996 Yavnieli
5,529,760 A 6/1996 Burris
5,532,798 A 7/1996 Nakagami et al.
5,535,089 A 7/1996 Ford et al.
5,536,477 A 7/1996 Cha et al.
5,538,695 A 7/1996 Shinjo et al.
5,540,761 A 7/1996 Yamamoto
5,542,967 A 8/1996 Ponizovsky et al.
5,545,379 A 8/1996 Gray
5,545,380 A 8/1996 Gray
5,547,643 A 8/1996 Nomoto et al.
5,549,874 A 8/1996 Kamiya et al.
5,554,344 A 9/1996 Duarte
5,554,345 A 9/1996 Kitchenman
5,569,368 A 10/1996 Larsky et al.
5,569,437 A 10/1996 Stiehl et al.
D375,546 S 11/1996 Lee
5,571,483 A 11/1996 Pfingstl et al.
5,573,577 A 11/1996 Joannou 5,573,730 A 11/1996 Gillum
5,578,112 A 11/1996 Krause
5,578,280 A 11/1996 Kazi et al.
5,582,632 A 12/1996 Nohr et al.
5,587,131 A 12/1996 Malkin et al.
D377,523 S 1/1997 Marvin et al.
5,591,253 A 1/1997 Altman et al.
5,591,334 A 1/1997 Shimizu et al.
5,591,412 A 1/1997 Jones et al.
5,593,476 A 1/1997 Coppom
5,601,636 A 2/1997 Glucksman
5,603,752 A 2/1997 Hara
5,603,893 A 2/1997 Gundersen et al.
5,614,002 A 3/1997 Chen
5,624,476 A 4/1997 Eyraud
5,630,866 A 5/1997 Gregg
5,630,990 A 5/1997 Conrad et al.
5,637,198 A 6/1997 Breault
5,637,279 A 6/1997 Besen et al.
5,641,342 A 6/1997 Smith et al.
5,641,461 A 6/1997 Ferone
5,647,890 A 7/1997 Yamamoto
5,648,049 A 7/1997 Jones et al.
5,655,210 A 8/1997 Gregoire et al.
5,656,063 A 8/1997 Hsu
5,665,147 A 9/1997 Taylor et al.
5,667,563 A 9/1997 Silva, Jr.
5,667,564 A 9/1997 Weinberg
5,667,565 A 9/1997 Gondar
5,667,756 A 9/1997 Ho
5,669,963 A 9/1997 Horton et al.
5,678,237 A 10/1997 Powell et al.
5,681,434 A 10/1997 Eastlund
5,681,533 A 10/1997 Hiromi
5,698,164 A 12/1997 Kishioka et al.
5,702,507 A 12/1997 Wang
D389,567 S 1/1998 Gudefin
5,766,318 A 6/1998 Loreth et al.
5,779,769 A 7/1998 Jiang
5,814,135 A 9/1998 Weinberg
5,879,435 A 3/1999 Satyapal et al.
5,893,977 A 4/1999 Pucci
5,911,957 A 6/1999 Khatchatrian et al.
5,972,076 A 10/1999 Nichols et al.
5,975,090 A 11/1999 Taylor et al.
5,980,614 A 11/1999 Loreth et al.
5,993,521 A 11/1999 Loreth et al.
5,997,619 A 12/1999 Knuth et al.
6,019,815 A 2/2000 Satyapal et al.
6,042,637 A 3/2000 Weinberg
6,063,168 A 5/2000 Nichols et al.
6,086,657 A 7/2000 Freije
6,117,216 A 9/2000 Loreth
6,118,645 A 9/2000 Partridge
6,126,722 A 10/2000 Mitchell et al.
6,126,727 A 10/2000 Lo
6,149,717 A 11/2000 Satyapal et al.
6,149,815 A 11/2000 Sauter
6,152,146 A 11/2000 Taylor et al.
6,163,098 A 12/2000 Taylor et al.
6,176,977 B1 1/2001 Taylor et al.
6,182,461 B1 2/2001 Washburn et al.
6,182,671 B1 2/2001 Taylor et al.
6,193,852 B1 2/2001 Caracciolo et al.
6,203,600 B1 3/2001 Loreth
6,212,883 B1 4/2001 Kang
6,228,149 B1 5/2001 Alenichev et al.
6,252,012 B1 6/2001 Egitto et al.
6,270,733 B1 8/2001 Rodden
6,277,248 B1 8/2001 Ishioka et al.
6,282,106 B2 8/2001 Grass
D449,097 S 10/2001 Smith et al.
D449,679 S 10/2001 Smith et al.
6,296,692 B1 10/2001 Gutmann
6,302,944 B1 10/2001 Hoenig
6,309,514 B1 10/2001 Conrad et al.
6,312,507 B1 11/2001 Taylor et al.
6,315,821 B1 11/2001 Pillion et al.
6,328,791 B1 12/2001 Pillion et al.
6,348,103 B1 2/2002 Ahlborn et al.
6,350,417 B1 2/2002 Lau et al.
6,362,604 B1 3/2002 Cravey
6,372,097 B1 4/2002 Chen
6,373,723 B1 4/2002 Wallgren et al.
6,379,427 B1 4/2002 Siess
6,391,259 B1 5/2002 Malkin et al.
6,398,852 B1 6/2002 Loreth
6,447,587 B1 9/2002 Pillion et al.
6,451,266 B1 9/2002 Lau et al.
6,464,754 B1 10/2002 Ford
6,471,753 B1 10/2002 Ahn et al.
6,494,940 B1 12/2002 Hak
6,504,308 B1 1/2003 Krichtafovitch et al.
6,508,982 B1 1/2003 Shoji
6,544,485 B1 4/2003 Taylor
6,585,935 B1 7/2003 Taylor et al.
6,588,434 B2 7/2003 Taylor et al.
6,603,268 B2 8/2003 Lee
6,613,277 B1 9/2003 Monagan
6,616,736 B2 * 9/2003 Massey et al. ..... 96/25
6,632,407 B1 10/2003 Lau et al.
6,635,105 B2 10/2003 Ahlborn et al.
6,672,315 B2 1/2004 Taylor et al.
6,709,484 B2 3/2004 Lau et al.
6,713,026 B2 3/2004 Taylor et al.
6,735,830 B1 5/2004 Merciel
6,749,667 B2 6/2004 Reeves et al.
6,753,652 B2 6/2004 Kim
6,761,796 B2 7/2004 Srivastava et al.
6,768,108 B2 7/2004 Hirano et al.
6,768,110 B2 7/2004 Alani
6,768,120 B2 7/2004 Leung et al.
6,768,121 B2 7/2004 Horsky et al.
6,770,878 B2 8/2004 Uhlemann et al.
6,774,359 B1 8/2004 Hirabayashi et al.
6,777,686 B2 8/2004 Olson et al.
6,777,699 B1 8/2004 Miley et al.
6,777,882 B2 8/2004 Goldberg et al.
6,781,136 B1 8/2004 Kato
6,785,912 B1 9/2004 Julio
6,791,814 B2 9/2004 Adachi et al.
6,794,661 B2 9/2004 Tsukihara et al.
6,797,339 B2 9/2004 Akizuki et al.
6,797,964 B2 9/2004 Yamashita
6,799,068 B1 9/2004 Hartmann et al.
6,800,862 B2 10/2004 Matsumoto et al.
6,803,585 B2 10/2004 Glukhoy
6,805,916 B2 10/2004 Cadieu
6,806,035 B1 10/2004 Atireklapvarodom et al.
6,806,163 B2 10/2004 Wu et al.
6,806,468 B2 10/2004 Laiko et al.
6,808,606 B2 10/2004 Thomsen et al.
6,809,310 B2 10/2004 Chen
6,809,312 B1 10/2004 Park et al.
6,809,325 B2 10/2004 Dahl et al.
6,812,647 B2 11/2004 Cornelius
6,815,690 B2 11/2004 Veerasamy et al.
6,818,257 B2 11/2004 Amann et al.
6,818,909 B2 11/2004 Murrell et al.
6,819,053 B2 11/2004 Johnson
6,863,869 B2 3/2005 Taylor et al.
6,896,853 B2 5/2005 Lau et al.
6,911,186 B2 6/2005 Taylor et al.
2001/0029728 A1 * 10/2001 Massey et al. ..... 55/471
2001/0048906 A1 12/2001 Lau et al.
2002/0069760 A1 6/2002 Pruette et al.

| | | | |
|---|---|---|---|
| 2002/0079212 | A1 | 6/2002 | Taylor et al. |
| 2002/0098131 | A1 | 7/2002 | Taylor et al. |
| 2002/0122751 | A1 | 9/2002 | Sinaiko et al. |
| 2002/0122752 | A1 | 9/2002 | Taylor et al. |
| 2002/0127156 | A1 | 9/2002 | Taylor |
| 2002/0134664 | A1 | 9/2002 | Taylor et al. |
| 2002/0134665 | A1 | 9/2002 | Taylor et al. |
| 2002/0141914 | A1 | 10/2002 | Lau et al. |
| 2002/0144601 | A1 | 10/2002 | Palestro et al. |
| 2002/0146356 | A1 | 10/2002 | Sinaiko et al. |
| 2002/0150520 | A1 | 10/2002 | Taylor et al. |
| 2002/0152890 | A1 | 10/2002 | Leiser |
| 2002/0155041 | A1 | 10/2002 | McKinney, Jr. et al. |
| 2002/0170435 | A1 | 11/2002 | Joannou |
| 2002/0190658 | A1 | 12/2002 | Lee |
| 2002/0195951 | A1 | 12/2002 | Lee |
| 2003/0005824 | A1 | 1/2003 | Katou et al. |
| 2003/0170150 | A1 | 9/2003 | Law et al. |
| 2003/0206837 | A1 | 11/2003 | Taylor et al. |
| 2003/0206839 | A1 | 11/2003 | Taylor et al. |
| 2003/0206840 | A1 | 11/2003 | Taylor et al. |
| 2004/0033176 | A1 | 2/2004 | Lee et al. |
| 2004/0052700 | A1 | 3/2004 | Kotlyar et al. |
| 2004/0065202 | A1 | 4/2004 | Gatchell et al. |
| 2004/0096376 | A1 | 5/2004 | Taylor |
| 2004/0136863 | A1 | 7/2004 | Yates et al. |
| 2004/0166037 | A1 | 8/2004 | Youdell et al. |
| 2004/0226447 | A1 | 11/2004 | Lau et al. |
| 2004/0234431 | A1 | 11/2004 | Taylor et al. |
| 2004/0237787 | A1 | 12/2004 | Reeves et al. |
| 2004/0251124 | A1 | 12/2004 | Lau |
| 2004/0251909 | A1 | 12/2004 | Taylor et al. |
| 2005/0000793 | A1 | 1/2005 | Taylor et al. |

FOREIGN PATENT DOCUMENTS

| | | | |
|---|---|---|---|
| CN | 87210843 | U | 7/1988 |
| CN | 2138764 | Y | 6/1993 |
| CN | 2153231 | Y | 12/1993 |
| DE | 2206057 | | 8/1973 |
| DE | 197 41 621 C 1 | | 6/1999 |
| EP | 0433152 | A1 | 12/1990 |
| EP | 0332624 | B1 | 1/1992 |
| FR | 2690509 | | 10/1993 |
| GB | 643363 | | 9/1950 |
| JP | S51-90077 | | 8/1976 |
| JP | S62-20653 | | 2/1987 |
| JP | S63-164948 | | 10/1988 |
| JP | 10137007 | | 5/1998 |
| JP | 11104223 | | 4/1999 |
| JP | 2000236914 | | 9/2000 |
| WO | WO 92/05875 | A1 | 4/1992 |
| WO | WO 96/04703 | A1 | 2/1996 |
| WO | WO 99/07474 | A1 | 2/1999 |
| WO | WO 00/10713 | A1 | 3/2000 |
| WO | WO 01/47803 | A1 | 7/2001 |
| WO | WO 01/48781 | A1 | 7/2001 |
| WO | WO 01/64349 | A1 | 9/2001 |
| WO | WO 01/85348 | A2 | 11/2001 |
| WO | WO 02/20162 | A2 | 3/2002 |
| WO | WO 02/20163 | A2 | 3/2002 |
| WO | WO 2/30574 | A1 | 4/2002 |
| WO | WO 02/32578 | A1 | 4/2002 |
| WO | WO 02/42003 | A1 | 5/2002 |
| WO | WO 02/066167 | A1 | 8/2002 |
| WO | WO 03/009944 | A1 | 2/2003 |
| WO | WO 03/013620 | A1 | 2/2003 |
| WO | WO 03/013734 AA | | 2/2003 |

OTHER PUBLICATIONS

U.S. Appl. No. 60/306,479, filed Jul. 18, 2001, Taylor.
U.S. Appl. No. 60/341,179, filed Dec. 13, 2001, Taylor et al.
U.S. Appl. No. 60/340,702, filed Dec. 13, 2001, Taylor et al.
U.S. Appl. No. 60/341,377, filed Dec. 13, 2001, Taylor et al.
U.S. Appl. No. 60/341,518, filed Dec. 13, 2001, Taylor.
U.S. Appl. No. 60/340,288, filed Dec. 13, 2001, Taylor.
U.S. Appl. No. 60/341,176, filed Dec. 13, 2001, Taylor.
U.S. Appl. No. 60/340,462, filed Dec. 13, 2001, Taylor.
U.S. Appl. No. 60/340,090, filed Dec. 13, 2001, Taylor.
U.S. Appl. No. 60/341,433, filed Dec. 13, 2001, Taylor.
U.S. Appl. No. 60/341,592, filed Dec. 13, 2001, Taylor.
U.S. Appl. No. 60/341,320, filed Dec. 13, 2001, Taylor.
U.S. Appl. No. 60/391,070, filed Jun. 6, 2002, Reeves.
Blueair AV 402 Air Purifier, http://www.air-purifiers-usa-biz/Blueair_AV402.htm, 4 pp., 1996.
Blueair AV 501 Air Purifier, http://www.air-purifiers-usa-biz/Blueair_AV501.htm, 15 pp., 1997.
ConsumerReports.org. "Air Cleaners: Behind the Hype," http://www.consumerreports.org/main/content/printable.jsp?FOLDER%3C%3EFOLDER_id, Oct. 2003, 6 pp.
Electrical schematic and promotional material available from Zenion Industries, 7 pages, Aug. 1990.
English Translation of German Patent Document DE 197 41 621 C1; Publication Date: Jun. 10, 1999.
English Translation of German Published Patent Application 2206057; Publication Date: Aug. 16, 1973.
English Translation of Japanese Unexamined Patent Application Bulletin No. S51-90077; Publication Date: Aug. 6, 1976.
English Translation of Japanese Unexamined Utility Model Application No. S62-20653; Publication Date: Feb. 7, 1987.
English Translation of Japanese Unexamined Utility Model Application No. S63-164948; Publication Date: Oct. 27, 1988.
Friedrich C-90A Electronic Air Cleaner, Service Information, Friedrich Air Conditioning Co., 12 pp., 1985.
Friedrich C-90A, "How the C-90A Works," BestAirCleaner.com http://www.bestaircleaner.com/faq/c90works.asp, 1 page, undated.
"Household Air Cleaners," Consumer Reports Magazine, Oct. 1992, 6 pp.
LakeAir Excel and Maxum Portable Electronic Air Cleaners, Operating and Service Manual, LakeAir International, Inc., 11 pp., 1971.
LENTEK Sila™ Plug-In Air Purifier/Deodorizer product box copyrighted 1999, 13 pages.
Promotional material available from Zenion Industries for the Plasma-Pure 100/200/300, 2 pages, Aug. 1990.
Promotional material available from Zenion Industries for the Plasma-Tron, 2 pages, Aug. 1990.
Trion 120 Air Purifier, Model 442501-025, http://www.feddersoutled.com/trion120.html, 16 pp., believed to be at least one year prior to Nov. 5, 1998.
Trion 150 Air Purifier, Model 45000-002, http://www.feddersoutlet.com/trion150.html, 11 pp., believed to be at least one year prior to Nov. 5, 1998.
Trion 350 Air Purifier, Model 450111-010, http://www.feddersoutlet.com/trion350.html, 12 pp., believed to be at least one year prior to Nov. 5, 1998.
Trion Console 250 Electronic Air Cleaner, Model Series 442857 and 445600, Manual for Installation-Operation-Maintenance, Trion Inc., 7 pp., believed to be at least one year prior to Nov. 5, 1998.
"Zenion Elf Device," drawing, prior art, undated.

* cited by examiner

AIR CONDITIONER DEVICE WITH ENHANCED ION OUTPUT PRODUCTION FEATURES

CLAIM OF PRIORITY

The present application is a continuation in part of U.S. patent application Ser. No. 11/003,671 filed Dec. 3, 2004, entitled "Air Conditioner Device With Variable Voltage Controlled Trailing Electrodes" which claims priority under 35 USC 119(e) to U.S. patent application Ser. No. 60/590,735, filed Jul. 23, 2004, and entitled "Air Conditioner Device With Variable Voltage Controlled Trailing Electrodes" both of which are hereby incorporated by reference.

CROSS-REFERENCE APPLICATIONS

The present invention is related to the following patent applications and patents, each of which is incorporated herein by reference:

U.S. patent application Ser. No. 10/074,207, filed Feb. 12, 2002, entitled "Electro-Kinetic Air Transporter-Conditioner Devices with Interstitial Electrode";

U.S. Pat. No. 6,176,977, entitled "Electro-Kinetic Air Transporter-Conditioner";

U.S. Pat. No. 6,544,485, entitled "Electro-Kinetic Device with Anti Microorganism Capability";

U.S. patent application Ser. No. 10/074,347, filed Feb. 12, 2002, and entitled "Electro-Kinetic Air Transporter-Conditioner Device with Enhanced Housing";

U.S. patent application Ser. No. 10/717,420, filed Nov. 19, 2003, entitled "Electro-Kinetic Air Transporter And Conditioner Devices With Insulated Driver Electrodes";

U.S. patent application Ser. No. 10/625,401, filed Jul. 23, 2003, entitled "Electro-Kinetic Air Transporter And Conditioner Devices With Enhanced Arcing Detection And Suppression Features";

U.S. patent application Ser. No. 10/944,016, filed Sep. 17, 2004, entitled "Electro-Kinetic Air Transporter And Conditioner Devices With Electrically Conductive Foam Emitter Electrode";

U.S. Pat. No. 6,350,417 issued May 4, 2000, entitled "Electrode Self Cleaning Mechanism For Electro-Kinetic Air Transporter-Conditioner";

U.S. Pat. No. 6,709,484, issued Mar. 23, 2004, entitled "Electrode Self-Cleaning Mechanism For Electro-Kinetic Air Transporter Conditioner Devices;

U.S. Pat. No. 6,350,417 issued May 4, 2000, and entitled "Electrode Self Cleaning Mechanism For Electro-Kinetic Air Transporter-Conditioner";

U.S. Patent Application No. 60/590,688, filed Jul. 23, 2004, entitled "Air Conditioner Device With Removable Driver Electrodes";

U.S. Patent Application No. 60/590,960, filed Jul. 23, 2003, entitled "Air Conditioner Device With Removable Interstitial Driver Electrodes";

U.S. Patent Application No. 60/590,445, filed Jul. 23, 2003, entitled "Air Conditioner Device With Enhanced Germicidal Lamp";

U.S. patent application Ser. No. 11/004,397, filed Dec. 3, 2004, entitled "Enhanced Germicidal Lamp";

U.S. patent application Ser. No. 10/791,561, filed Mar. 2, 2004, entitled "Electro-Kinetic Air Transporter and Conditioner Devices including Pin-Ring Electrode Configurations with Driver Electrode";

U.S. patent application Ser. No. 11/003,894, filed Dec. 3, 2004, entitled "Air Conditioner Device With Removable Driver Electrodes";

U.S. patent application Ser. No. 11/006,344, filed Dec. 3, 2004, entitled "Air Conditioner Device With Individually Removable Driver Electrodes"";

U.S. patent application Ser. No. 11/003,032, filed Dec. 3, 2004, entitled "Air Conditioner Device With Enhanced Germicidal Lamp"";

U.S. patent application Ser. No. 11/003,516, filed Dec. 3, 2004, entitled "Air Conditioner Device With Removable Driver Electrodes";

U.S. Patent Application No. 60/646,725 filed Jan. 25, 2005, entitled "Electrostatic Precipitator With Insulated Driver Electrodes";

U.S. Patent Application No. 60/646,876 filed Jan. 25, 2005, entitled "Air Conditioner Device With Ozone-reducing Agent Associated With An Electrode Assembly";

U.S. Patent Application No. 60/646,956 filed Jan. 25, 2005, entitled "Air Conditioner Device With A Temperature Conditioning Device Having A Rechargeable Thermal Storage Mass";

U.S. Patent Application No. 60/646,908 filed Jan. 25, 2005, entitled "Air Conditioner Device With A Temperature Conditioning Device Having A Thermoelectric Heat Exchanger";

U.S. Provisional Patent Application Ser. No. 60/545,698, filed Feb. 18, 2004 and entitled, "Electro-Kinetic Air Transporter And/Or Conditioner Devices With Features For Cleaning Emitter Electrodes;

U.S. Provisional Patent Application Ser. No. 60/579,481, filed Jun. 14, 2004 and entitled, "Air Transporter And/Or Conditioner Devices With Features For Cleaning Emitter Electrodes";

U.S. patent application Ser. No. 10/774,759 filed Feb. 9, 2004, entitled "Electrostatic Precipitators With Insulated Driver Electrodes"; and U.S. Patent Application No. 60/646,771 filed Jan. 25, 2005, entitled "Air Conditioner Device With Partially Insulated Collector Electrode".

FIELD OF THE INVENTION

The present invention is related generally to a device for conditioning air and, in particular, to a device that includes an initial cleaning boost operation.

BACKGROUND OF THE INVENTION

The use of an electric motor to rotate a fan blade to create an airflow has long been known in the art. Unfortunately, such fans can produce substantial noise. Although such fans can produce substantial airflow (e.g., 1,000 $ft^3$/minute or more), substantial electrical power is required to operate the motor, and essentially no conditioning of the flowing air occurs.

It is known to provide such fans with a HEPA-compliant filter element to remove particulate matter larger than perhaps 0.3 μm. Unfortunately, the resistance to airflow presented by the filter element may require doubling the electric motor size to maintain a desired level of airflow. Further, HEPA-compliant filter elements are expensive, and can represent a substantial portion of the sale price of a HEPA-compliant filter-fan unit. While such filter-fan units can condition the air by removing large particles, particulate matter small enough to pass through the filter element is not removed, including bacteria, for example.

It is also known in the art to produce an airflow using electro-kinetic technique whereby electrical power is converted into a flow of air without utilizing mechanically moving components. One such system is described in U.S. Pat. No. 4,789,801 to Lee (1988), depicted herein in simplified form as FIGS. 1A and 1B, which is hereby incorporated by reference. System 10 includes an array of first ("emitter") electrodes or conductive surfaces 20 that are spaced-apart from an array of second ("collector") electrodes or conductive surfaces 30. The positive terminal of a generator such as, for example, pulse generator 40 which outputs a train of high voltage pulses (e.g., 0 to perhaps +5 KV) is coupled to the first array 20, and the negative pulse generator terminal is coupled to the second array 30 in this example.

The high voltage pulses ionize the air between the arrays 20, 30 and create an airflow 50 from the first array 20 toward the second array 30, without requiring any moving parts. Particulate matter 60 entrained within the airflow 50 also moves towards the second electrodes 30. Much of the particulate matter is electrostatically attracted to the surfaces of the second electrodes 30, where it remains, thus conditioning the flow of air that is exiting the system 10. Further, the high voltage field present between the electrode sets releases ozone 03, into the ambient environment, which eliminates odors that are entrained in the airflow.

In the particular embodiment of FIG. 1A, the first electrodes 20 are circular in cross-section, having a diameter of about 0.003" (0.08 mm), whereas the second electrodes 30 are substantially larger in area and define a "teardrop" shape in cross-section. The ratio of cross-sectional radii of curvature between the bulbous front nose of the second electrode 30 and the first electrodes 20 exceeds 10:1. As shown in FIG. 1A, the bulbous front surfaces of the second electrodes 30 face the emitter electrodes 20, and the somewhat "sharp" trailing edges face the exit direction of the airflow. In another particular embodiment shown herein as FIG. 1B, second electrodes 30 are elongated in cross-section. The elongated trailing edges on the second electrodes 30 provide increased area upon which particulate matter 60 entrained in the airflow can attach.

Existing air cleaners utilizing electro-kinetic techniques are advantageous in effectively and efficiently cleaning the air in a room over a period of time. In other words, the nature of the electro-kinetic air cleaners require that the air cleaners be continually left on in the room to allow the cleaner to gradually clean the room over a period of time. This method effectively relieves the user from having to continuously turn on and turn off the device when he or she desires to clean the room.

Although device exist which clean the air and collect particles over a period of time, there is a need for a system which provides the user with a feeling of refreshment and increased cleaning for a short period of time upon the cleaner being initially turned on.

DETAILED DESCRIPTION OF THE PRESENT INVENTION

Figure 1A:
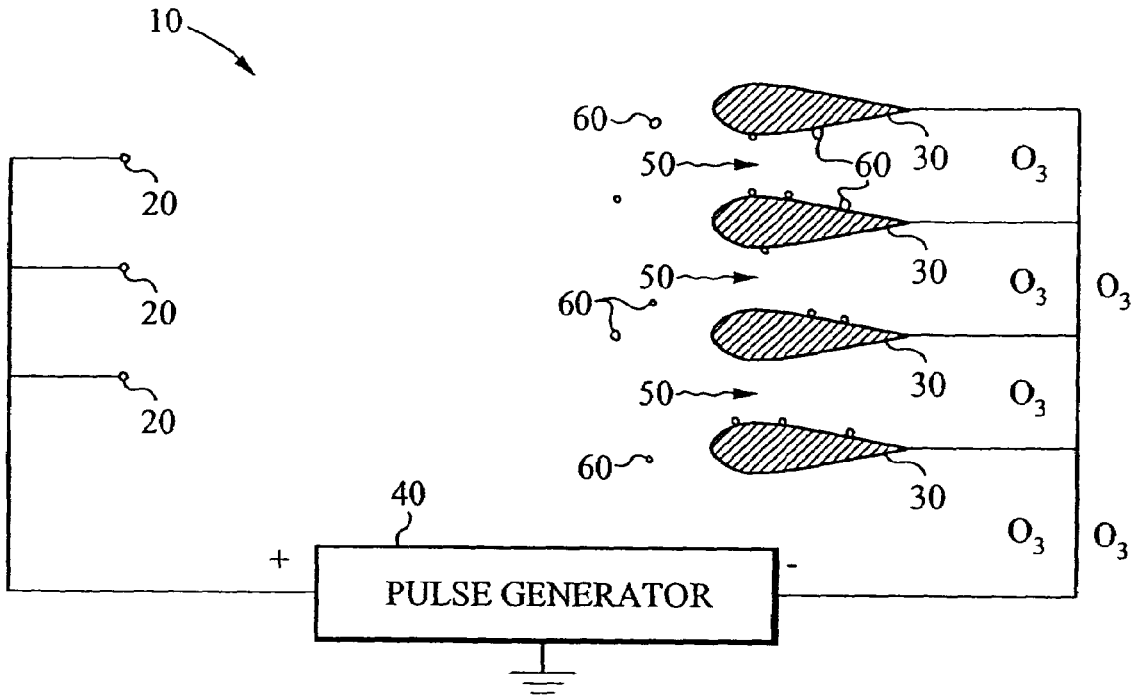
Fig. 1A (PRIOR ART)
FIG. 1A illustrates a plan, cross-sectional view, of a prior art electro-kinetic air transporter-conditioner system.
Figure 1B:
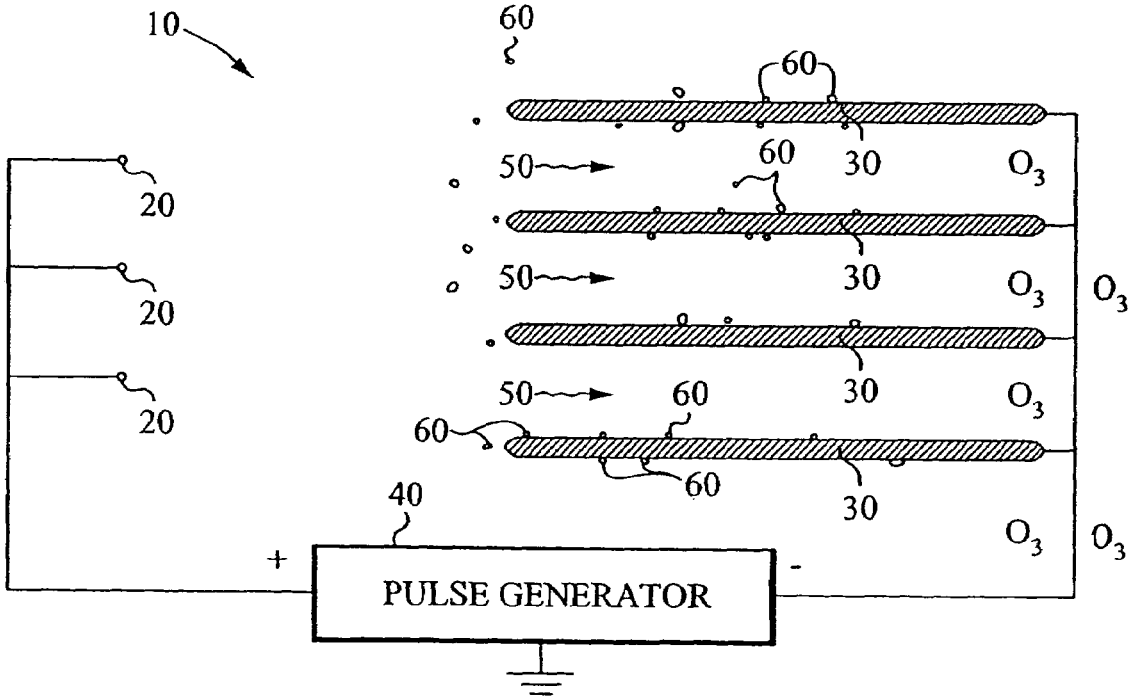
Fig. 1B (PRIOR ART)
FIG. 1B illustrates a plan, cross-sectional view of a prior art electro-kinetic air transporter-conditioner system.
Figure 2:
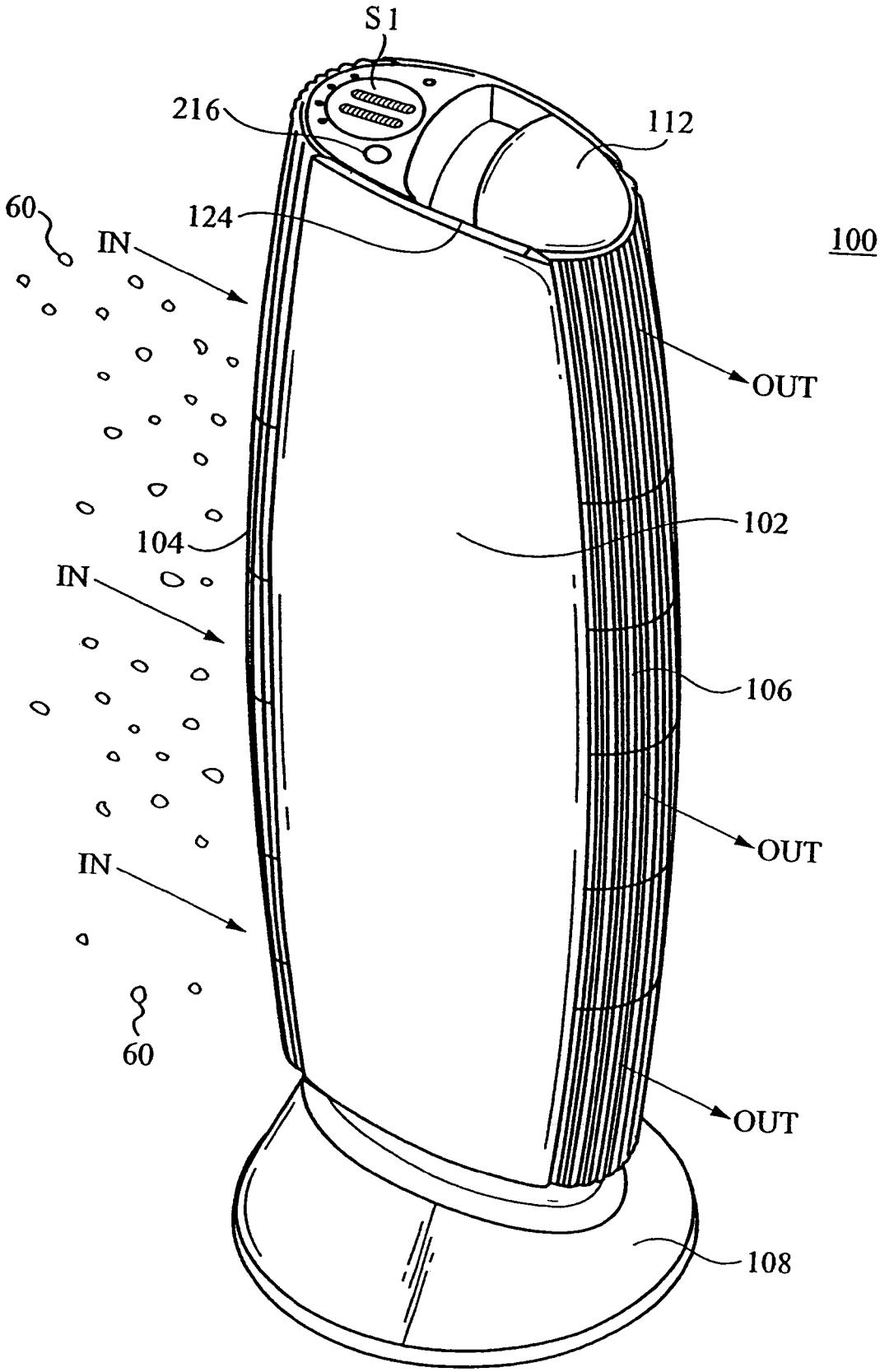
FIG. 2 illustrates a perspective view of the device in accordance with one embodiment of the present invention.

FIG. 2 depicts one embodiment of the air conditioner system 100 whose housing 102 preferably includes a removable rear-located intake grill 104, a removable front-located exhaust grill 106, and a base pedestal 108. Alternatively, a single grill provides both an air intake and an air exhaust with an air inlet channel and an air exhaust channel communicating with the grill and the air movement system within. The housing 102 is preferably freestanding and/or upstandingly vertical and/or elongated. Internal to the transporter housing 102 is an ion generating unit 320 (FIG. 3) which is preferably powered by an AC:DC power supply that is energizable or excitable using switch S1. S1 is conveniently located at the top 124 of the housing 102. Located preferably on top of the housing 102 is a boost button 216 which can boost the ion output of the system, as will be discussed below. The ion generating unit 320 is self-contained in that, other than ambient air, nothing is required from beyond the transporter housing, save external operating potential, for operation of the present invention. In one embodiment, a fan is utilized to supplement and/or replace the movement of air caused by the operation of the emitter and collector electrodes, as described below. In one embodiment, the system 100 includes a germicidal lamp within which reduces the amount of microorganisms exposed to the lamp when passed through the system 100. The germicidal lamp 290 (FIG. 5) is preferably a UV-C lamp 290 that emits radiation having wavelength of about 254 nm, which is effective in diminishing or destroying bacteria, germs, and viruses to which it is exposed. More detail regarding the germicidal lamp is described in the U.S. patent application Ser. No. 10/074,347, which was incorporated by reference above. In another embodiment, the system 100 does not utilize the germicidal lamp.

The general shape of the housing 102 in the embodiment shown in FIG. 2 is that of an oval cross-section. Alternatively, the housing 102 includes a differently shaped cross-section such as, but not limited to, a rectangular shape, a figure-eight shape, an egg shape, a tear-drop shape, or circular shape. As will become apparent later, the housing 102 is shaped to contain the air movement system. In one embodiment, the air movement system is an electrode assembly 320 (FIG. 3), as discussed below. Alternatively, or additionally, the air movement system is a fan or other appropriate mechanism.

Figure 6:
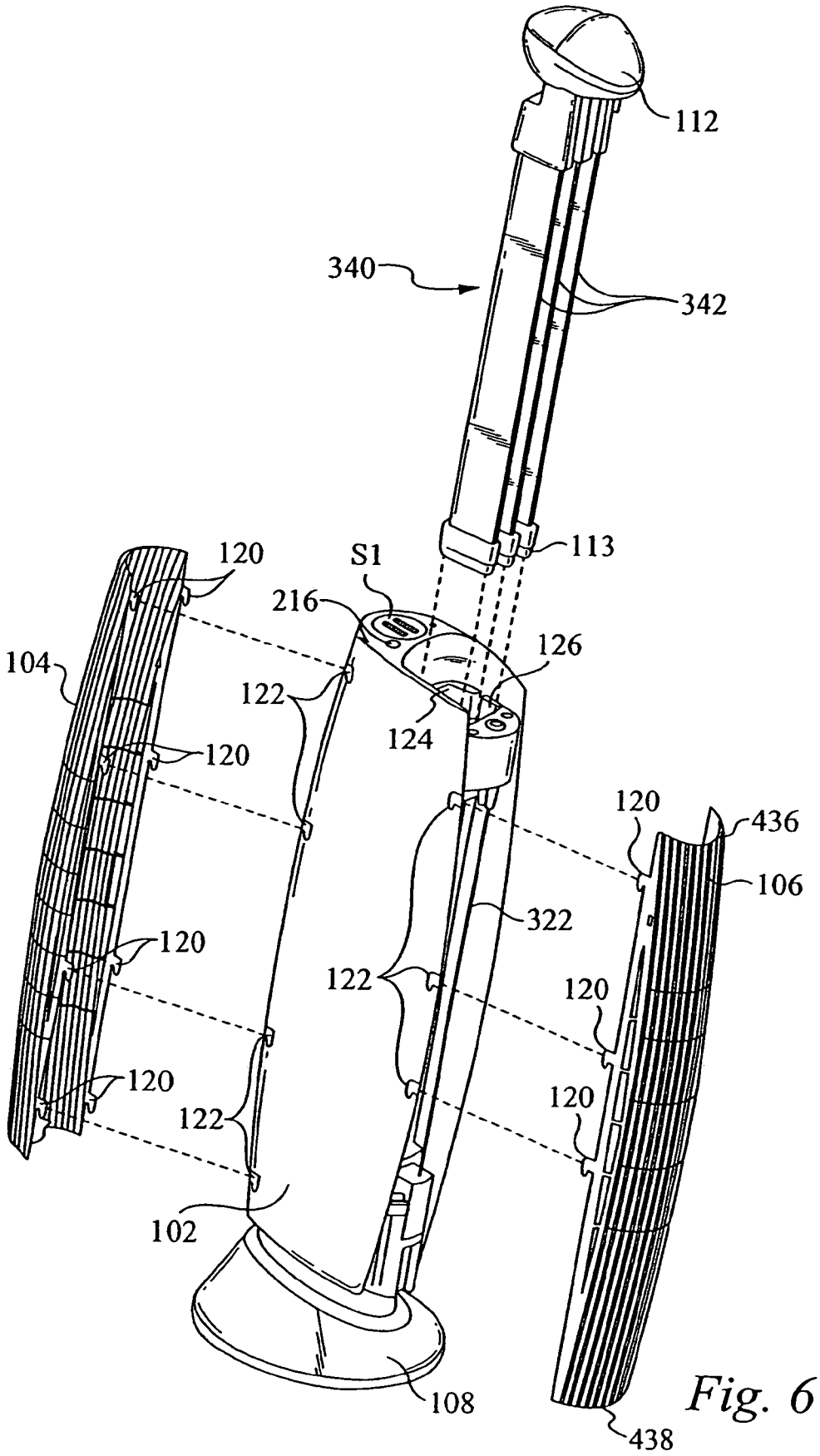
FIG. 6 illustrates an exploded view of the device shown in FIG. 2 in accordance with one embodiment of the present invention.

Both the inlet and the outlet grills 104, 106 are covered by fins or louvers. In accordance with one embodiment, each fin is a thin ridge spaced-apart from the next fin, so that each fin creates minimal resistance as air flows through the housing 102. As shown in FIG. 2, the fins are vertical and are directed along the elongated vertical upstanding housing 102 of the system 100, in one embodiment. Alternatively, the fins are perpendicular to the elongated housing 102 and are configured horizontally. In one embodiment, the inlet and outlet fins are aligned to give the unit a "see through" appearance. Thus, a user can "see through" the system 100 from the inlet to the outlet or vice versa. The user will see no moving parts within the housing, but just a quiet unit that cleans the air passing there through. Other orientations of fins and electrodes are contemplated in other embodiments, such as a configuration in which the user is unable to see through the system 100 which contains the germicidal lamp 290 therein. There is preferably no distinction between grills 104 and 106, except their location relative to the collector electrodes 342 (FIG. 6). Alternatively, the grills 104 and 106 are configured differently and are distinct from one another. The grills 104, 106 serve to ensure that an adequate flow of ambient air is drawn into or made available to the system 100 and that an adequate flow of ionized air that includes appropriate amounts of ozone flows out from the system 100 via the outlet grill 106.

When the system 100 is energized by activating switch S1, high voltage or high potential output by the ion generator, also termed electrode assembly, produces at least ions within the system 100. The "IN" notation in FIG. 2 denotes the intake of ambient air with particulate matter 60 through the inlet grill 104. The "OUT" notation in FIG. 2 denotes the outflow of cleaned air through the outlet grill 106 substantially devoid of the particulate matter 60. It is desired to provide the inner surface of the housing 102 with an electrostatic shield to reduce detectable electromagnetic radiation. For example, a metal shield is disposed within the housing 102, or portions of the interior of the housing 102 are alternatively coated with a metallic paint to reduce such radiation.

Figure 3:
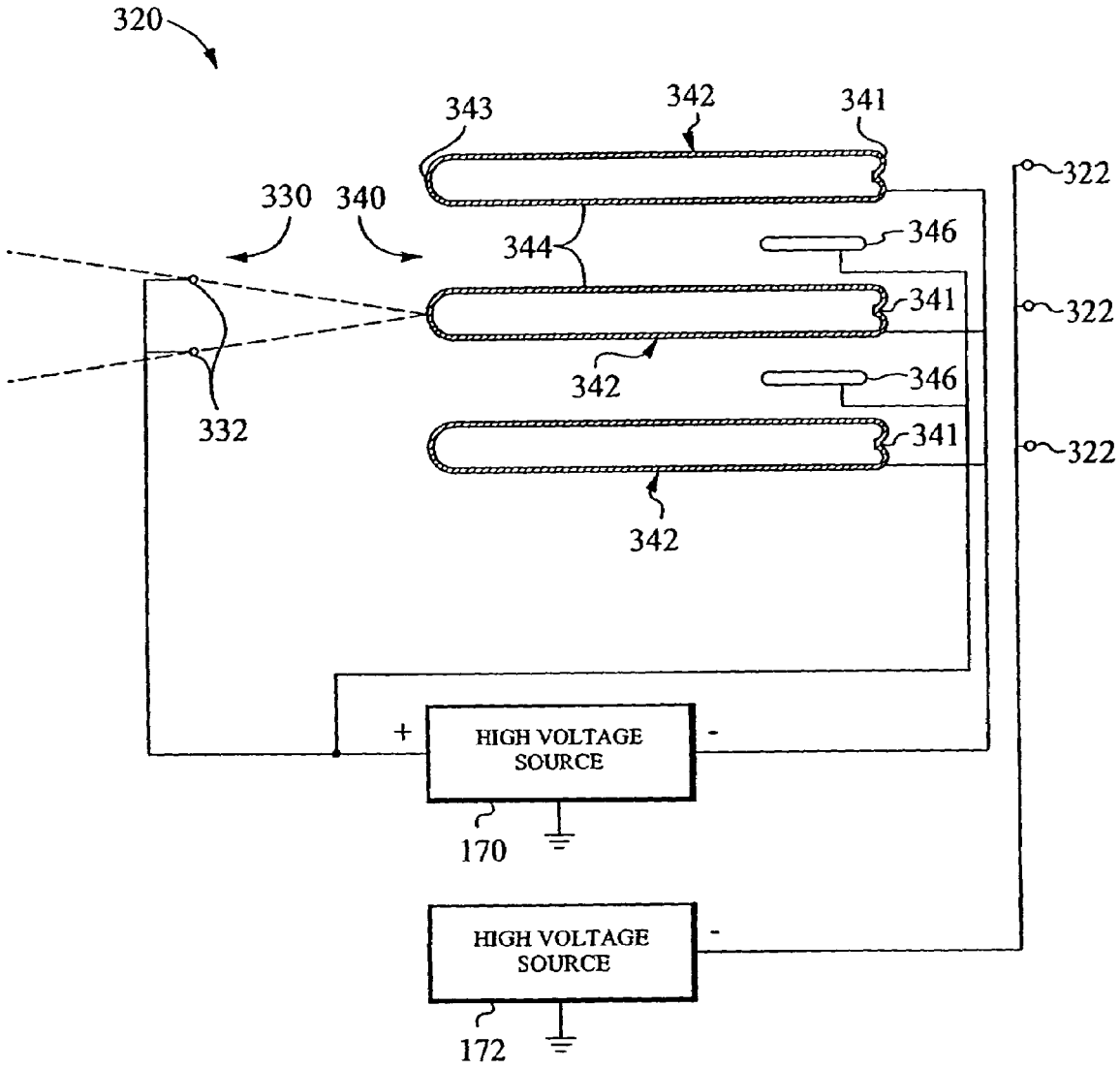
FIG. 3 illustrates a plan view of the electrode assembly in accordance with one embodiment of the present invention.

FIG. 3 illustrates a plan view of one embodiment of the electrode assembly in accordance with one embodiment of the present invention. As shown in FIG. 3, the electrode assembly 320 comprises a first set 330 of at least one emitter electrode or conductive surface 332, and further comprises a second set 340 of at least one collector or second electrode or conductive surface 342. It is preferred that the number N1 of electrodes 332 in the first set 330 differ by one relative to the number N2 of electrodes 342 in the second set 340. Preferably, the system includes a greater number of second electrodes 342 than first electrodes 330. However, if desired, additional first electrodes 332 are alternatively positioned at the outer ends of set 330 such that N1>N2, e.g., five first electrodes 332 compared to four second electrodes 342. As shown in FIG. 3, the emitter electrodes are preferably wire-shaped. The terms "wire" and "wire-shaped" shall be used interchangeably herein to mean an electrode either made from a wire or another component that is thicker and/or stiffer than a wire.

In other embodiments, the emitter wire are configured as pin or needle shaped electrodes which are used in place of a wire. For example, an elongated saw-toothed edge can be used, with each tooth functioning as a corona discharge point. A column of tapered pins or needles would function similarly. In another embodiment, a plate with a single or plurality of sharp downstream edges can be used as an emitter electrode. These are just a few examples of the emitter electrodes that can be used with embodiments of the present invention. In addition, the collector electrodes 342 are configured to define side regions 344, an end 341 and a bulbous region 343. The collector electrodes 342 are preferably plate-shaped and elongated.

The material(s) of the electrodes 332 and 342 should conduct electricity and be preferably resistant to the corrosive effects from the application of high voltage, but yet strong and durable enough to be cleaned periodically. In one embodiment, the electrodes 332 in the first electrode set 330 are fabricated from tungsten. Tungsten is sufficiently robust in order to withstand cleaning, has a high melting point to retard breakdown due to ionization, and has a rough exterior surface that promotes efficient ionization. The electrodes 342 preferably have a highly polished exterior surface to minimize unwanted point-to-point discharge. As such, the electrodes 342 are fabricated from stainless steel and/or brass, among other appropriate materials. The polished surface of electrodes 342 also promotes ease of electrode cleaning. The materials and construction of the electrodes 332,342, allow the electrodes 332, 342 to be light weight, easy to fabricate, and lend themselves to mass production. Further, electrodes 332,342 described herein promote more efficient generation of ionized air, and appropriate amounts of ozone. Although FIG. 3 shows two first electrodes 332 and three second electrodes 342, it is apparent to one skilled in the art that any number of first electrodes 332 and second electrodes 342, including but are not limited to only one of each, is contemplated.

As shown in FIG. 3, one embodiment of the present invention preferably includes a first high voltage source (HVS) 170 and a second high power voltage source 172. The positive output terminal of the first HVS 170 is coupled to the emitter electrodes 332 in the first electrode set 330, and the negative output terminal of first HVS 170 is coupled to collector electrodes 342. It is believed that with this arrangement, the net polarity of the emitted ions is positive, e.g., more positive ions than negative ions are emitted. This coupling polarity has been found to work well and minimizes unwanted audible electrode vibration or hum. However, while generation of positive ions is conducive to a relatively silent airflow, from a health standpoint it may be desired that the output airflow be richer in negative ions than positive ions. It is noted that in some embodiments, one port, such as the negative port, of the high voltage power supply can in fact be the ambient air. Thus, the electrodes 342 in the second set 340 need not be connected to the HVS 170 using a wire. Nonetheless, there will be an "effective connection" between the collector electrodes 342 and one output port of the HVS 170, in this instance, via ambient air. Alternatively the negative output terminal of HVS 170 is connected to the first electrode set 330 and the positive output terminal is connected to the second electrode set 340.

When voltage or pulses from the HVS 170 are generated across the first and second electrodes 330 and 340, a plasma-like field is created surrounding the electrodes 332 in first set 330. This electric field ionizes the ambient air between the first and the second electrode sets 330, 340 and establishes an "OUT" airflow that moves towards the second electrodes 340. It is understood that the IN flow preferably enters via grill(s) 104 and that the OUT flow exits via grill(s) 106 as shown in FIG. 2.

Ozone and ions are generated simultaneously by the first electrodes 332 as a function of the voltage potential from the HVS 170. Ozone generation is increased or decreased by respectively increasing or decreasing the voltage potential at the first electrode set 330. Coupling an opposite polarity voltage potential to the second electrodes 342 accelerates the motion of ions from the first set 330 to the second set 340, thereby producing the airflow. As the ions and ionized particulates move toward the second set 340, the ions and ionized particles push or move air molecules toward the second set 340. The relative velocity of this motion is increased, by way of example, by increasing the voltage potential at the second set 340 relative to the potential at the first set 330.

As shown in the embodiment in FIG. 3, at least one output trailing electrode 322 is electrically coupled to the second HVS 172. The trailing electrode 322 generates a substantial amount of negative ions, because the electrode 322 is coupled to relatively negative high potential. In one embodiment, the trailing electrode(s) 322 is a wire positioned downstream from the second electrodes 342. In one embodiment, the electrode 322 has a pointed shape in the side profile, e.g., a triangle. Alternatively, at least a portion of the trailing edge in the second electrode 342 has a pointed electrode region which emits the supplemental negative ions, as described in U.S. patent application Ser. No. 10/074, 347 which was incorporated by reference above.

The negative ions produced by the trailing electrode 322 neutralize excess positive ions otherwise present in the output airflow, such that the OUT flow has a net negative charge. The trailing electrodes 322 are preferably made of stainless steel, copper, or other conductor material. The inclusion of one electrode 322 has been found sufficient to provide a sufficient number of output negative ions. However, multiple trailing wire electrodes 322 are preferably utilized.

When the trailing electrodes 322 are electrically connected to the negative terminal of the second HVS 172, the positively charged particles within the airflow can be attracted to and collect on the trailing electrodes 322. In a typical electrode assembly with no trailing electrode 322, most of the particles will collect on the surface area of the collector electrodes 342. However, some particles will pass through the system 100 without being collected by the collector electrodes 342. The trailing electrodes 322 can also serve as a second surface area to collect the positively charged particles.

In addition and as discussed below, when energized the trailing electrodes 322 can aid in removing particles from the air. These energized trailing electrodes 322 can energize any remaining particles leaving the air conditioner system 100. While these particles are not collected by the collector electrode 342, they may be collected by other surfaces in their immediate environment in which collection will reduce the particles in the air in that environment. In one embodiment, when the system 100 is initially turned on, the trailing electrodes 322 can be turned on at a high level for a specified period, preferably 20 minutes or other appropriate period, in order to assist in initially cleaning the environment of particulates. After the initial on-period, the trailing electrodes 332 can be turned off for a period or alternatively operated intermittently or in addition operated at a lower rate in order to output negative ions which may be useful for the environment. As will be explained below, the boost button 216 is configured to operate the trailing electrodes 322 in one embodiment. In one embodiment, the trailing electrodes 322 are turned on when the system 100 is initially turned on in order, for example, to remove additional particulates from the air. The trailing electrodes 322 can be left on by the system 100 for a specified period, such as 20 minutes as specified above, whereby the trailing electrodes 322 can be turned off, thereafter. The user is able to, as desired, press the boost button 216 again in order to again have the elevated output from the trailing electrodes 322. At this higher output level, the boost button 216 can glow one color. The boost button 216 can be pushed again to operate the trailing electrodes 322 intermittently, or at a lower level, in order to output useful negative ions to the environment. The boost button 216 in this mode can glow a different color In the embodiments shown in FIGS. 3 and 4, the electrode assembly 320 also includes driver electrodes 346 located interstitially between the collector electrodes 342. It is apparent that other number sand arrangements of emitter electrodes 332, collector electrodes 344, trailing electrodes 322 and driver electrodes 346 can be configured. In one embodiment, the driver electrodes 346 each have an underlying electrically conductive electrode provided on a printed circuit board substrate material that is insulated by a dielectric material, including, but not limited to insulating varnish, lacquer, resin, ceramic, porcelain enamel, a heat shrink polymer (such as, for example, a polyolefin) or fiberglass. In another embodiment, the driver electrodes 346 are not insulated.

In one embodiment, the driver electrodes 346 as well as the emitter electrodes 332 are positively charged, whereas the collector electrodes 342 are negatively charged as shown in FIG. 3. In particular, the drivers 346 are electrically coupled to the positive terminal of either the first or second HVS 170, 172. The emitter electrodes 332 apply a positive charge to particulates passing by the electrodes 332. The electric fields which are produced between the driver electrodes 346 and the collector electrodes 342 will thus push the positively charged particles toward the collector electrodes 204. Generally, the greater this electric field between the driver electrodes 346 and the collector electrodes 342, the greater the migration velocity and the particle collection efficiency of the electrode assembly 320.

Figure 4:
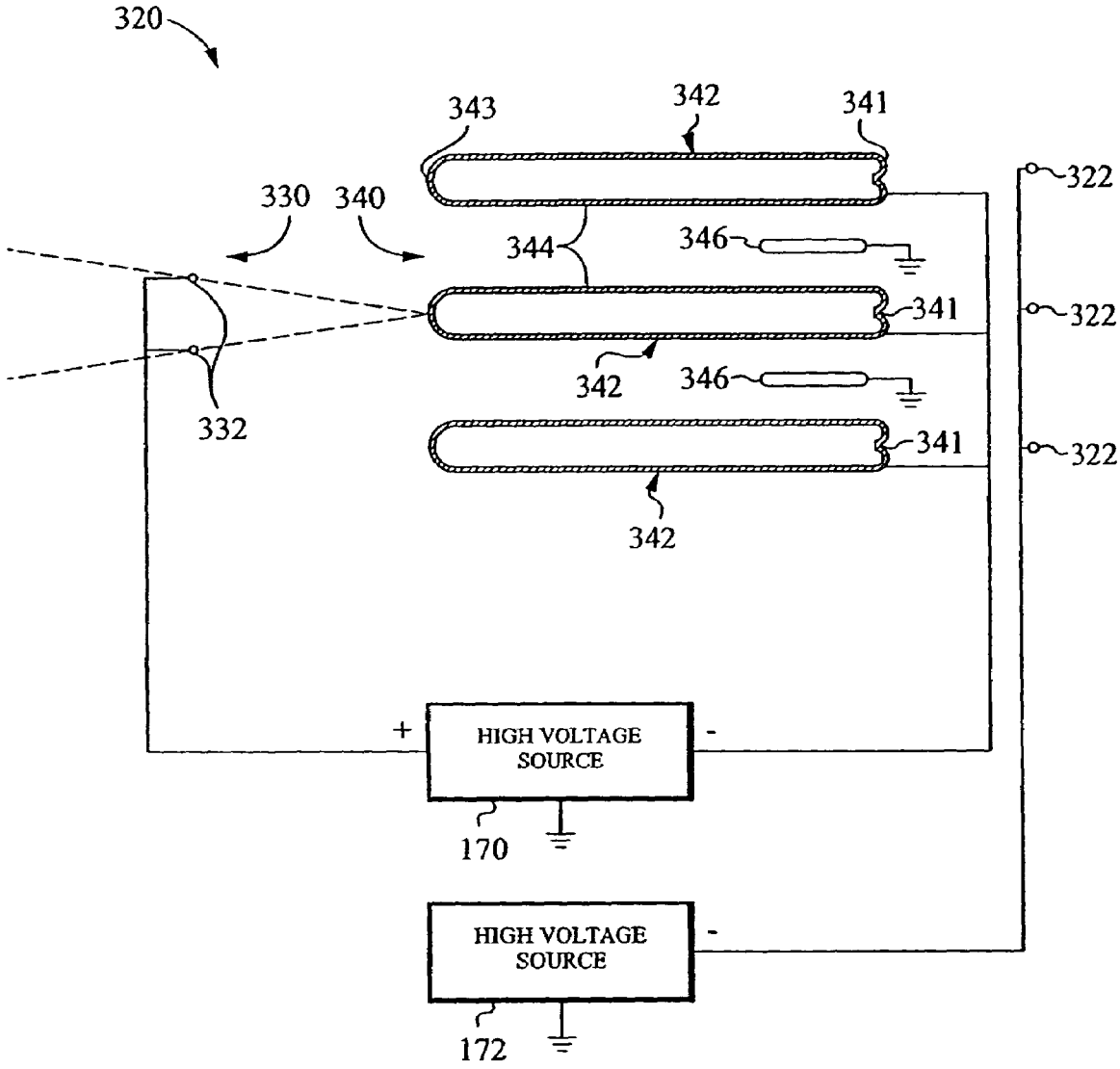
FIG. 4 illustrates a plan view of the electrode assembly in accordance with one embodiment of the present invention.

In another embodiment, the driver electrodes 346 are electrically connected to ground as shown in FIG. 4. Although the grounded drivers 346 do not receive a charge from the first or second HVS 170, 172, the drivers 346 may still deflect positively charged particles toward the collector electrodes 342. In another embodiment, the driver electrodes 346 are electrically coupled to the negative terminal of either the first or second HVS 170, 172, whereby the driver electrodes 346 are preferably charged at a voltage that is less negative than the negatively charged collector electrodes 342.

The extent that the voltage difference (and thus, the electric field) between the collector electrodes 342 and un-insulated driver electrodes 346 can be increased beyond a certain voltage potential difference is limited due to arcing which may occur. However, with the insulated drivers 346 the voltage potential difference that can be applied between the collector electrodes 342 and the driver electrodes 346 without arcing is significantly increased. The increased potential difference results in an increased electric field, which significantly increases particle collecting efficiency. More details regarding the insulated driver electrodes 346 are described in the U.S. patent application Ser. No. 10/717, 420 which was incorporated by reference above.

Figure 5A:
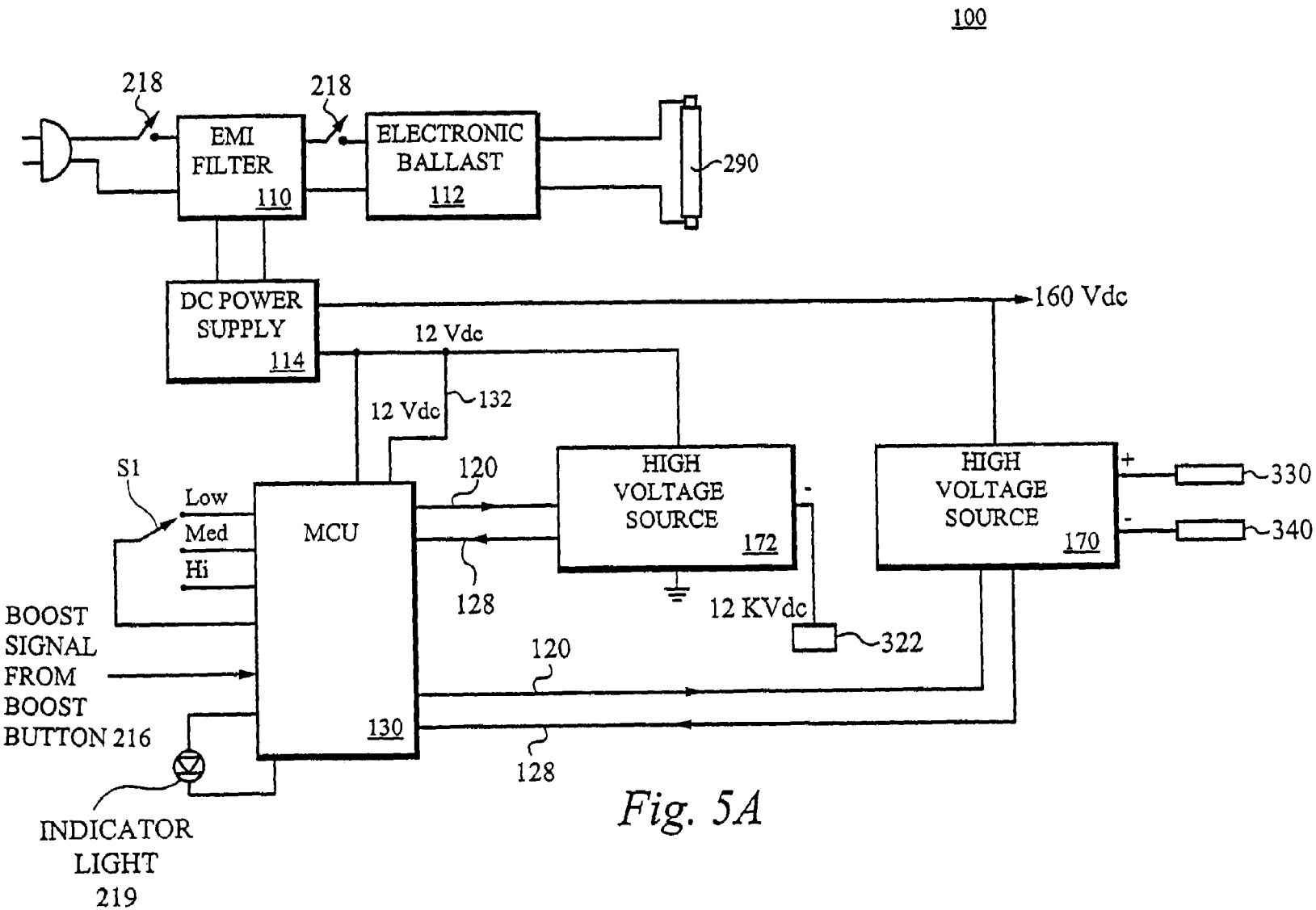
FIG. 5A illustrates an electrical block diagram of the high voltage power source of one embodiment of the present invention.

FIG. 5A illustrates an electrical circuit diagram for the system 100, according to one embodiment of the present invention. The system 100 has an electrical power cord that plugs into a common electrical wall socket that provides a nominal 110 VAC. An electromagnetic interference (EMI) filter 110 is placed across the incoming nominal 110 VAC line to reduce and/or eliminate high frequencies generated by the various circuits within the system 100, such as the electronic ballast 112. In one embodiment, the electronic ballast 112 is electrically connected to a germicidal lamp 290 (e.g. an ultraviolet lamp) to regulate, or control, the flow of current through the lamp 290. A switch 218 is used to turn the lamp 290 on or off. The EMI Filter 110 is well known in the art and does not require a further description. In another embodiment, the system 100 does not include the germicidal lamp 290, whereby the circuit diagram shown in FIG. 5A would not include the electronic ballast 112, the germicidal lamp 290, nor the switch 218 used to operate the germicidal lamp 290.

The EMI filter 110 is coupled to a DC power supply 114. The DC power supply 114 is coupled to the first HVS 170 as well as the second high voltage power source 172. The high voltage power source can also be referred to as a pulse generator. The DC power supply 114 is also coupled to the micro-controller unit (MCU) 130. The MCU 130 can be, for example, a Motorola 68HC908 series micro-controller, available from Motorola. Alternatively, any other type of MCU is contemplated. The MCU 130 can receive a signal from the switch S1 as well as a boost signal from the boost button 216. The MCU 130 also includes an indicator light 219 which specifies when the electrode assembly is ready to be cleaned.

The DC Power Supply 114 is designed to receive the incoming nominal 110 VAC and to output a first DC voltage (e.g., 160 VDC) to the HVS 170. The DC Power Supply 114 voltage (e.g., 160 VDC) is also stepped down to a second DC voltage (e.g., 12 VDC) for powering the micro-controller unit (MCU) 130, the HVS 172, and other internal logic of the system 100. The voltage is stepped down through a resistor network, transformer or other component.

As shown in FIG. 5A, the first HVS 170 is coupled to the first electrode set 330 and the second electrode set 340 to provide a potential difference between the electrode sets. In one embodiment, the first HVS 170 is electrically coupled to the driver electrode 346, as described above. In addition, the first HVS 170 is coupled to the MCU 130, whereby the MCU receives arc sensing signals 128 from the first HVS 170 and provides low voltage pulses 120 to the first HVS 170. Also shown in FIG. 5A is the second HVS 172 which is coupled to the trailing electrode 322 to provide a voltage to the electrodes 322. In addition, the second HVS 172 is coupled to the MCU 130, whereby the MCU receives arc sensing signals 128 from the second HVS 172 and provides low voltage pulses 120 to the second HVS 172.

In accordance with one embodiment of the present invention, the MCU 130 monitors the stepped down voltage (e.g., about 12 VDC), which is referred to as the AC voltage sense signal 132 in FIG. 5A, to determine if the AC line voltage is above or below the nominal 110 VAC, and to sense changes in the AC line voltage. For example, if a nominal 110 VAC increases by 10% to 121 VAC, then the stepped down DC voltage will also increase by 10%. The MCU 130 can sense this increase and then reduce the pulse width, duty cycle and/or frequency of the low voltage pulses to maintain the output power (provided to the HVS 170) to be the same as when the line voltage is at 110 VAC. Conversely, when the line voltage drops, the MCU 130 can sense this decrease and appropriately increase the pulse width, duty cycle and/or frequency of the low voltage pulses to maintain a constant output power. Such voltage adjustment features of the present invention also enable the same system 100 to be used in different countries that have different nominal voltages than in the United States (e.g., in Japan the nominal AC voltage is 100 VAC).

Figure 5B:
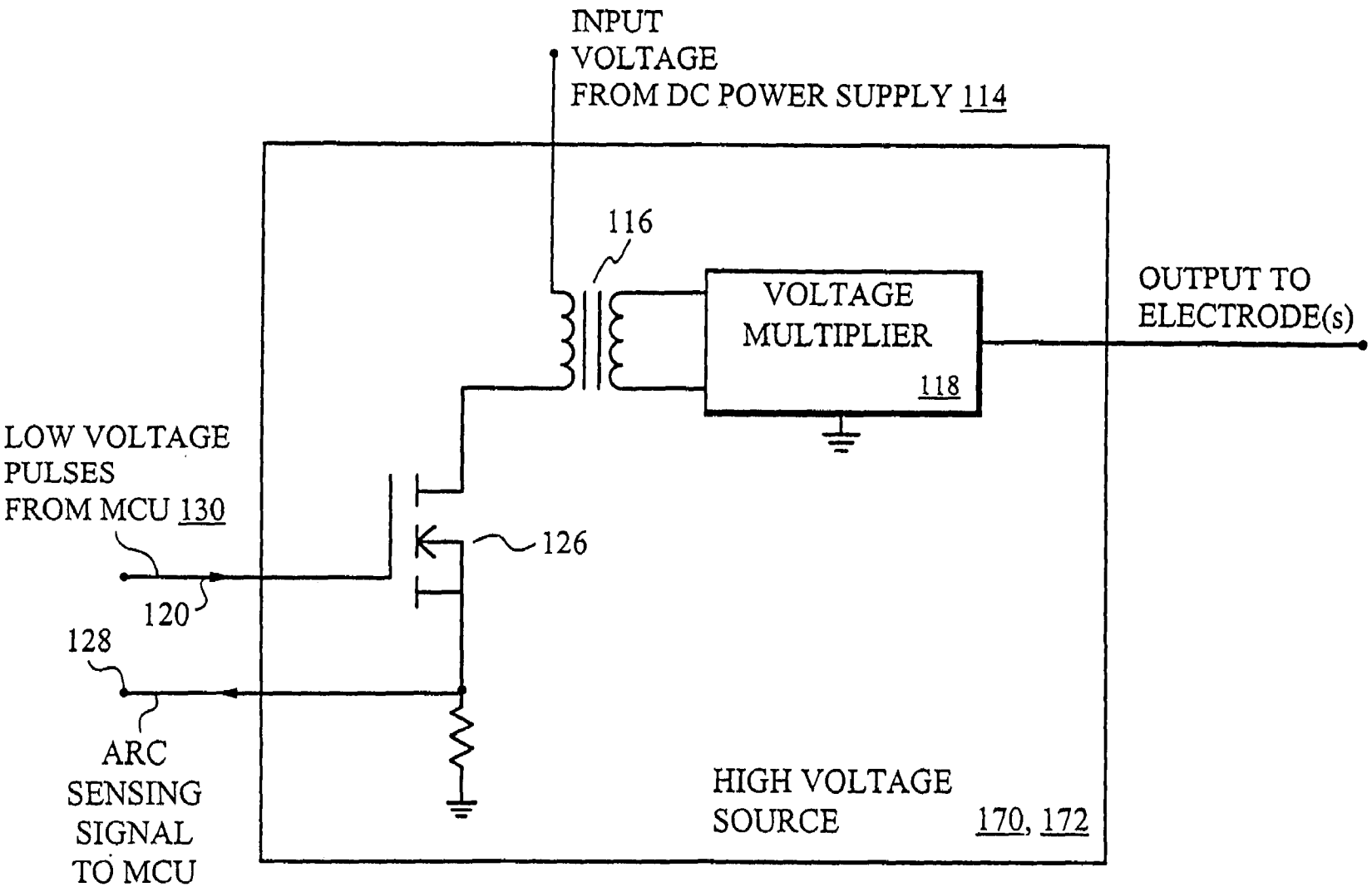
FIG. 5B illustrates an electrical block diagram of the high voltage power source in accordance with one embodiment of the present invention.

FIG. 5B illustrates a schematic block diagram of the high voltage power supply in accordance with one embodiment of the present invention. For the present description, the first and second HVSs 170, 172 include the same or similar components as that shown in FIG. 5B. However, it is apparent to one skilled in the art that the first and second HVSs 170, 172 are alternatively comprised of different components from each other as well as those shown in FIG. 5B. The various circuits and components comprising the first and second HVS 170, 172 can, for example, be fabricated on a printed circuit board mounted within housing 210. The MCU 130 can be located on the same circuit board or a different circuit board.

In the embodiment shown in FIG. 5B, the HVSs 170,172 include an electronic switch 126, a step-up transformer 116 and a voltage multiplier 118. The primary side of the step-up transformer 116 receives the DC voltage from the DC power supply 114. For the first HVS 170, the DC voltage received from the DC power supply 114 is approximately 160 Vdc. For the second HVS 172, the DC voltage received from the DC power supply 114 is approximately 12 Vdc. An electronic switch 126 receives low voltage pulses 120 (of perhaps 20-25 KHz frequency) from the MCU 130. Such a switch is shown as an insulated gate bipolar transistor (IGBT) 126. The IGBT 126, or other appropriate switch, couples the low voltage pulses 120 from the MCU 130 to the input winding of the step-up transformer 116. The secondary winding of the transformer 116 is coupled to the voltage multiplier 118, which outputs the high voltage pulses to the electrode(s). For the first HVS 170, the electrode(s) are the emitter and collector electrode sets 330 and 340. For the second HVS 172, the electrode(s) are the trailing electrodes 322. In general, the IGBT 126 operates as an electronic on/off switch. Such a transistor is well known in the art and does not require a further description.

When driven, the first and second HVSs 170,172 receive the low input DC voltage from the DC power supply 114 and the low voltage pulses from the MCU 130 and generate high voltage pulses of preferably at least 5 KV peak-to-peak with a repetition rate of about 20 to 25 KHz. The voltage multiplier 118 in the first HVS 170 outputs between 5 to 9 KV to the first set of electrodes 230 and between −6 to −18 KV to the second set of electrodes 340. In the preferred embodiment, the emitter electrodes 332 receive approximately 5 to 6 KV whereas the collector electrodes 342 receive approximately −9 to −10 KV. The voltage multiplier 118 in the second HVS 172 outputs approximately −12 KV to the trailing electrodes 322. In one embodiment, the driver electrodes 346 are preferably connected to ground. It is within the scope of the present invention for the voltage multiplier 118 to produce greater or smaller voltages. The high voltage pulses preferably have a duty cycle of about 10%-15%, but may have other duty cycles, including a 100% duty cycle.

The MCU 130 is coupled to a control dial S1, as discussed above, which can be set to a LOW, MEDIUM or HIGH airflow setting as shown in FIG. 5A. The MCU 130 controls the amplitude, pulse width, duty cycle and/or frequency of the low voltage pulse signal to control the airflow output of the system 100, based on the setting of the control dial S1. In one embodiment, the MCU 130 adjusts the amplitude, pulse width, frequency, and/or duty cycle to increase the voltage potential when the system 100 is initially turned on. To increase the airflow output, the MCU 130 can be set to increase the amplitude, pulse width, frequency and/or duty cycle. Conversely, to decrease the airflow output rate, the MCU 130 is able to reduce the amplitude, pulse width, frequency and/or duty cycle. In accordance with one embodiment, the low voltage pulse signal 120 has a fixed pulse width, frequency and duty cycle for the LOW setting, another fixed pulse width, frequency and duty cycle for the MEDIUM setting, and a further fixed pulse width, frequency and duty cycle for the HIGH setting.

In accordance with one embodiment of the present invention, the low voltage pulse signal 120 modulates between a predetermined duration of a "high" airflow signal and a "low" airflow signal. It is preferred that the low voltage signal modulates between a predetermined amount of time when the airflow is to be at the greater "high" flow rate, followed by another predetermined amount of time in which the airflow is to be at the lesser "low" flow rate. This is preferably executed by adjusting the voltages provided by the first HVS to the first and second sets of electrodes for the greater flow rate period and the lesser flow rate period. This produces an acceptable airflow output while limiting the ozone production to acceptable levels, regardless of whether the control dial S1 is set to HIGH, MEDIUM or LOW. For example, the "high" airflow signal can have a pulse width of 5 microseconds and a period of 40 microseconds (i.e., a 12.5% duty cycle), and the "low" airflow signal can have a pulse width of 4 microseconds and a period of 40 microseconds (i.e., a 10% duty cycle).

In general, the voltage difference between the first set 330 and the second set 340 is proportional to the actual airflow output rate of the system 100. Thus, the greater voltage differential is created between the first and second set electrodes 330,340 by the "high" airflow signal, whereas the lesser voltage differential is created between the first and second set electrodes 330, 340 by the "low" airflow signal. In one embodiment, the airflow signal causes the voltage multiplier 118 to provide between 5 and 9 KV to the first set electrodes 330 and between −9 and −10 KV to the second set electrodes 340. For example, the "high" airflow signal causes the voltage multiplier 118 to provide 5.9 KV to the first set electrodes 330 and −9.8 KV to the second set electrodes 340. In the example, the "low" airflow signal causes the voltage multiplier 118 to provide 5.3 KV to the first set electrodes 330 and −9.5 KV to the second set electrodes 340. It is within the scope of the present invention for the MCU 130 and the first HVS 170 to produce voltage potential differentials between the first and second sets electrodes 330 and 340 other than the values provided above and is in no way limited by the values specified.

In accordance with the preferred embodiment of the present invention, when the control dial S1 is set to HIGH, the electrical signal output from the MCU 130 will continuously drive the first HVS 170 and the airflow, whereby the electrical signal output modulates between the "high" and "low" airflow signals stated above (e.g. 2 seconds "high" and 10 seconds "low"). When the control dial S1 is set to MEDIUM, the electrical signal output from the MCU 130 will cyclically drive the first HVS 170 (i.e. airflow is "On") for a predetermined amount of time (e.g., 20 seconds), and then drop to a zero or a lower voltage for a further predetermined amount of time (e.g., a further 20 seconds). It is to be noted that the cyclical drive when the airflow is "On" is preferably modulated between the "high" and "low" airflow signals (e.g. 2 seconds "high" and 10 seconds "low"), as stated above. When the control dial S1 is set to LOW, the signal from the MCU 130 will cyclically drive the first HVS 170 (i.e. airflow is "On") for a predetermined amount of time (e.g., 20 seconds), and then drop to a zero or a lower voltage for a longer time period (e.g., 80 seconds). Again, it is to be noted that the cyclical drive when the airflow is "On" is preferably modulated between the "high" and "low" airflow signals (e.g. 2 seconds "high" and 10 seconds "low"), as stated above. It is within the scope and spirit of the present invention the HIGH, MEDIUM, and LOW settings will drive the first HVS 170 for longer or shorter periods of time. It is also contemplated that the cyclic drive between "high" and "low" airflow signals are durations and voltages other than that described herein.

Cyclically driving airflow through the system 100 for a period of time, followed by little or no airflow for another period of time (i.e. MEDIUM and LOW settings) allows the overall airflow rate through the system 100 to be slower than when the dial S1 is set to HIGH. In addition, cyclical driving reduces the amount of ozone emitted by the system since little or no ions are produced during the period in which lesser or no airflow is being output by the system. Further, the duration in which little or no airflow is driven through the system 100 provides the air already inside the system a longer dwell time, thereby increasing particle collection efficiency. In one embodiment, the long dwell time allows air to be exposed to a germicidal lamp, if present.

Regarding the second HVS 172, approximately 12 volts DC is applied to the second HVS 172 from the DC Power Supply 114. In one embodiment, the second HVS 172 provides a negative charge (e.g. −12 KV) to one or more trailing electrodes 322 in one embodiment. However, it is contemplated that the second HVS 172 provides a voltage in the range of, and including, −10 KV to −60 KV in other embodiments. In one embodiment, other voltages produced by the second HVS 172 are contemplated. In one embodiment, the second HVS 172 can be used to provide an overriding voltage potential which is higher than the voltage potential supplied by the first HVS 170

In one embodiment, the second HVS 172 is controllable independently from the first HVS 170 (as for example by the boost button 216) to allow the user to variably increase or decrease the amount of negative ions output by the trailing electrodes 322 without correspondingly increasing or decreasing the amount of voltage provided to the first and second set of electrodes 330,340. The second HVS 172 thus provides freedom to operate the trailing electrodes 322 independently of the remainder of the electrode assembly 320 to reduce static electricity, eliminate odors and the like. In addition, the second HVS 172 allows the trailing electrodes 322 to operate at a different duty cycle, amplitude, pulse width, and/or frequency than the electrode sets 330 and 340. In one embodiment, the user is able to vary the voltage supplied by the second HVS 172 to the trailing electrodes 322 at any time by depressing the button 216. In one embodiment, the user is able to turn on or turn off the second HVS 172, and thus the trailing electrodes 322, without affecting operation of the electrode assembly 320 and/or the germicidal lamp 290. It should be noted that the second HVS 172 can also be used to control electrical components other than the trailing electrodes 322 (e.g. driver electrodes and germicidal lamp).

In one embodiment, the system 100 includes a boost button 216. In one embodiment, the trailing electrodes 322 as well as the electrode sets 330, 340 are controlled by the boost signal from the boost button 216 input into the MCU 130. In one embodiment, as mentioned above, the boost button 216 cycles through a set of operating settings upon the boost button 216 being depressed. In the example embodiment discussed below, the system 100 includes three operating settings. However, any number of operating settings are contemplated within the scope of the invention.

The following discussion presents methods of operation of the boost button 216 which are variations of the methods discussed above. In particular, the system 100 will operate in a first boost setting when the boost button 216 is pressed once. In the first boost setting, the MCU 130 drives the first HVS 170 as if the control dial S1 was set to the HIGH setting for a predetermined amount of time (e.g., 6 minutes), even if the control dial S1 is set to LOW or MEDIUM (in effect overriding the setting specified by the dial S1). The predetermined time period may be longer or shorter than 6 minutes. For example, the predetermined period can also preferably be 20 minutes if a higher cleaning setting for a longer period of time is desired. This will cause the system 100 to run at a maximum airflow rate for the predetermined boost time period. In one embodiment, the low voltage signal modulates between the "high" airflow signal and the "low" airflow signal for predetermined amount of times and voltages, as stated above, when operating in the first boost setting. In another embodiment, the low voltage signal does not modulate between the "high" and "low" airflow signals.

In the first boost setting, the MCU 130 will also operate the second HVS 172 to operate the trailing electrode 322 to generate ions, preferably negative, into the airflow. In one embodiment, the trailing electrode 322 will preferably repeatedly emit ions for one second and then terminate for five seconds for the entire predetermined boost time period. The increased amounts of ozone from the boost level will further reduce odors in the entering airflow as well as increase the particle capture rate of the system 100. At the end of the predetermined boost period, the system 100 will return to the airflow rate previously selected by the control dial S1. It should be noted that the on/off cycle at which the trailing electrodes 322 operate are not limited to the cycles and periods described above.

In the example, once the boost button 216 is pressed again, the system 100 operates in the second setting, which is an increased ion generation or "feel good" mode. In the second setting, the MCU 130 drives the first HVS 170 as if the control dial S1 was set to the LOW setting, even if the control dial S1 is set to HIGH or MEDIUM (in effect overriding the setting specified by the dial S1). Thus, the airflow is not continuous, but "On" and then at a lesser or zero airflow for a predetermined amount of time (e.g. 6 minutes). In addition, the MCU 130 will operate the second HVS 172 to operate the trailing electrode 322 to generate negative ions into the airflow. In one embodiment, the trailing electrode 322 will repeatedly emit ions for one second and then terminate for five seconds for the predetermined amount of time. It should be noted that the on/off cycle at which the trailing electrodes 322 operate are not limited to the cycles and periods described above.

In the example, upon the boost button 216 being pressed again, the MCU 130 will operate the system 100 in a third operating setting, which is a normal operating mode. In the third setting, the MCU 130 drives the first HVS 170 depending on the which setting the control dial S1 is set to (e.g. HIGH, MEDIUM or LOW). In addition, the MCU 130 will operate the second HVS 172 to operate the trailing electrode 322 to generate ions, preferably negative, into the airflow at a predetermined interval. In one embodiment, the trailing electrode 322 will repeatedly emit ions for one second and then terminate for nine seconds. In another embodiment, the trailing electrode 322 does not operate at all in this mode. The system 100 will continue to operate in the third setting by default until the boost button 216 is pressed. It should be noted that the on/off cycle at which the trailing electrodes 322 operate are not limited to the cycles and periods described above.

In one embodiment, the present system 100 operates in an automatic boost mode upon the system 100 being initially plugged into the wall and/or initially being turned on after being off for a predetermined amount of time. This is referred to herein as the initial boost or start-up period. In one embodiment, upon the system 100 being turned on, the MCU 130 automatically drives the first HVS 170 as if the control dial S1 was set to the HIGH setting for a predetermined amount of time, as discussed above, even if the control dial S1 is set to LOW or MEDIUM. Therefore, this causes the system 100 to run at a maximum airflow rate for that amount of time and thus have an increased particle collection efficiency. In addition, or alternatively, the MCU 130 automatically operates the second HVS 172 to operate the trailing electrode 222 at a maximum ion emitting rate to generate ions, preferably negative, into the airflow for the same amount of time. Once the system 100 has been operating at the increased level during the initial boost period, the system 100 automatically adjusts the airflow rate and ion emitting rate to be in the normal operating mode. For example, the system 100 can operate in the initial boost period for 20 minutes, although other time periods are contemplated.

In one embodiment, as discussed above, the system 100 is driven by the MCU 130 as if the control dial S1 was set to the HIGH setting when initially turned on. In another embodiment, the MCU 130 adjusts the duty cycle, pulse width, frequency, and/or amplitude of the voltage pulses during the initial boost period to increase the voltage potential between the emitter and collector electrodes. In another embodiment, an auxilliary high voltage source, such as the second HVS 172 can override the first HVS 170 and supplies a higher voltage potential between the emitter and collector electrodes during the initial boost period.

This initial boost period feature allows the system 100 to effectively clean stale, pungent, and/or polluted air in a room which the system 100 has not been continuously operating in. As stated, the nature and design of the electro-kinetic cleaning technique of the present system allows the system 100 to operate effectively when left to clean a room over a long period of time. The system thus allows the user to turn on the system 100 and leave it on to clean the air in the room without having to constantly monitor its operation, such as turning on and off the system 100 when desired. Nonetheless, the initial boost feature of the present invention provides a feeling of refreshment to the user upon turning on the system 100 and provides a short period of time of intensified cleaning. This feature thus improves the air quality produced by the system 100 at a faster rate while emitting negative "feel good" ions to quickly eliminate any odor in the room when the system 100 is initially turned on. Thereafter, the system adjusts to operate in a normal operating mode to continually clean the room for the duration of its operation.

In addition, the system 100 will include an indicator light which informs the user what mode the system 100 is operating in the initial boost period and/or when the boost button 216 is depressed. In one embodiment, the indicator light is the same as the cleaning indicator light 219 discussed above. In another embodiment, the indicator light is a separate light from the indicator light 219. For example only, the indicator light will emit a blue light when the system 100 operates in the first setting. In addition, the indicator light will emit a green light when the system 100 operates in the second setting. In the example, the indicator light will not emit a light when the system 100 is operating in the third setting.

The MCU 130 provides various timing and maintenance features in one embodiment. For example, the MCU 130 can provide a cleaning reminder feature (e.g., a 2 week timing feature) that provides a reminder to clean the system 100

(e.g., by causing indicator light 219 to turn on amber, and/or by triggering an audible alarm that produces a buzzing or beeping noise). The MCU 130 can also provide arc sensing, suppression and indicator features, as well as the ability to shut down the first HVS 170 in the case of continued arcing. The MCU 130 preferably monitors the amount of elapsed time in which the system 100 operates in the initial boost mode. Details regarding arc sensing, suppression and indicator features are described in U.S. patent application Ser. No. 10/625,401 which was incorporated by reference above.

FIG. 6 illustrates an exploded view of the system 100 in accordance with one embodiment of the present invention. As shown in the embodiment in FIG. 6, the upper surface of housing 102 includes a user-liftable handle member 112 which is affixed to the collector electrodes 342 of the electrode set 320 (FIG. 5). In the embodiment shown in FIG. 6, the lifting member 112 lifts the second electrodes 342 upward thereby causing the second electrodes 342 to telescope out of the aperture 126 in the top surface 124 of the housing 102 and, and if desired, out of the system 100 for cleaning.

In one embodiment, the second electrodes 342 are lifted vertically out of the housing 102 while the emitter electrodes 332 remain in the system 100. In another embodiment, the entire electrode assembly 220 is configured to be lifted out of the system 100, whereby the first electrode set 330 and the second electrode set 340 are lifted together or independent of one another. In FIG. 6, the bottom ends of the second electrodes 342 are connected to a base member 113. In another embodiment, a mechanism (not shown) is coupled to the base member 113 which includes a flexible member and a slot for capturing and cleaning the first electrodes 332 whenever the handle member 112 is moved vertically by the user. More detail regarding the cleaning mechanism is provided in the U.S. patent application Ser. No. 09/924,600 which was incorporated by reference above.

Figure 7:
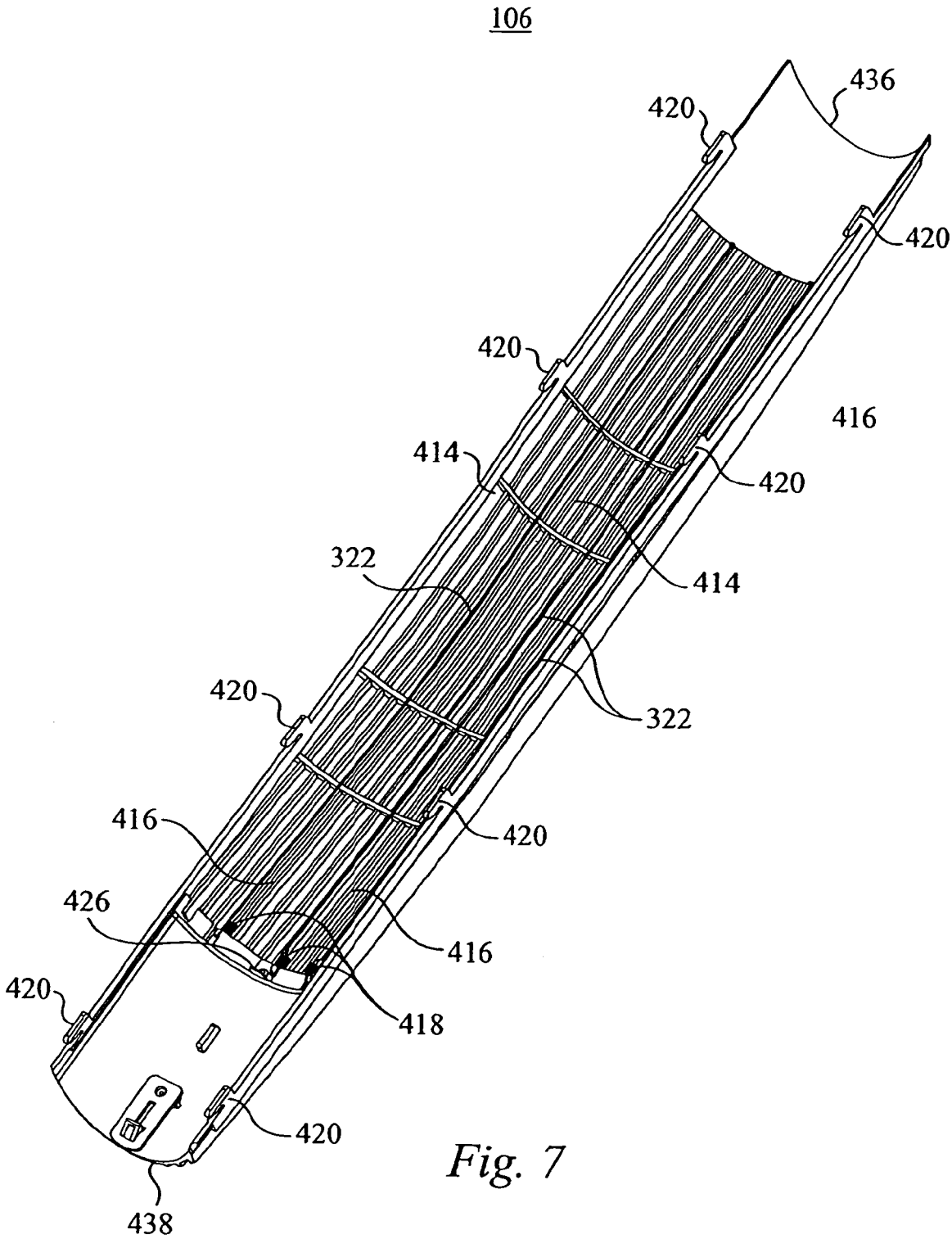
FIG. 7 illustrates a perspective view of the exhaust grill of the device shown in FIGS. 2 and 6 in accordance with one embodiment of the present invention.
Figure 8:
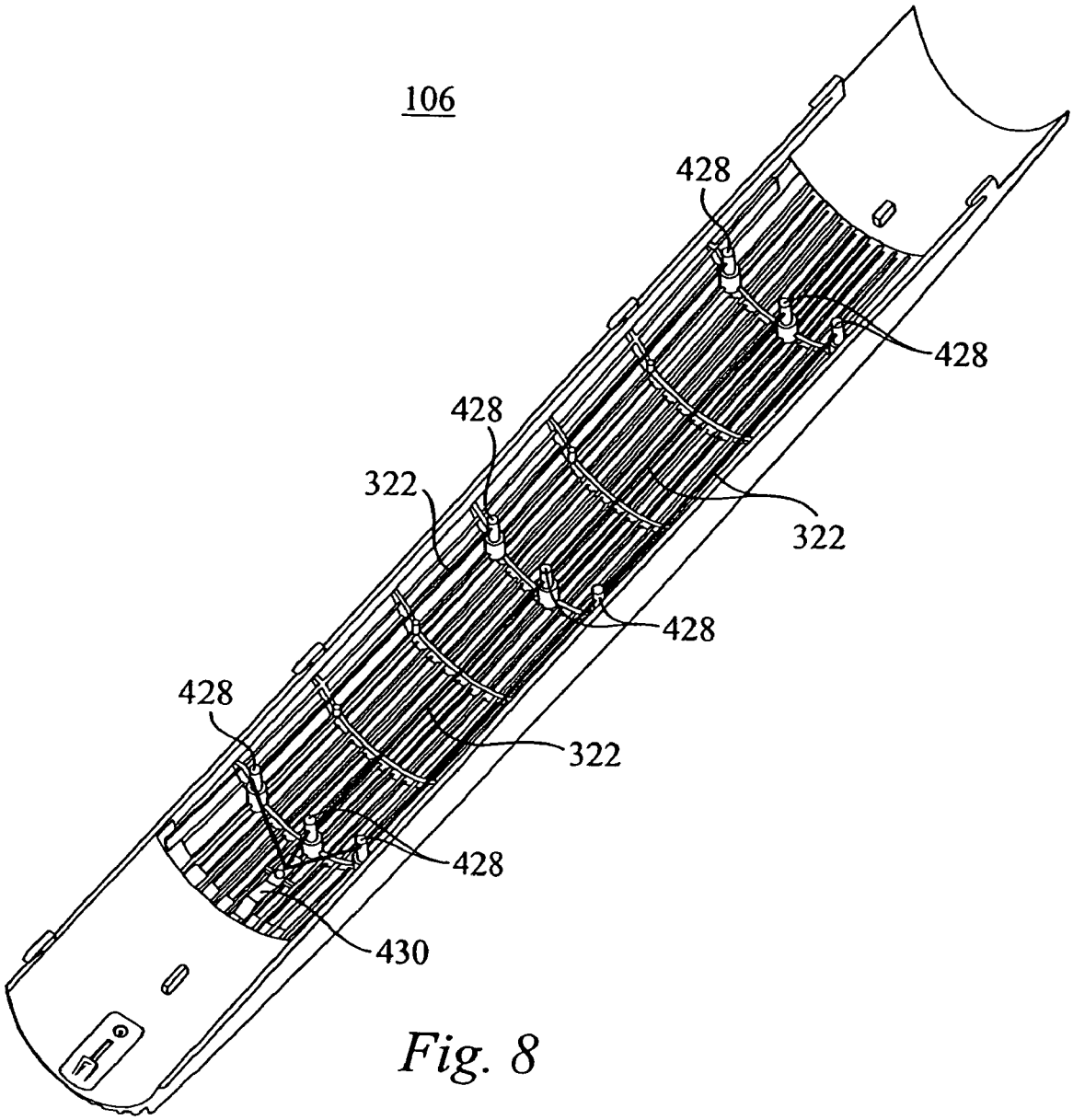
FIG. 8 illustrates a perspective view of the exhaust grill of the device shown in FIGS. 2 and 6 in accordance with one embodiment of the present invention.

In addition, as shown in FIG. 6, the inlet grill 104 as well as the exhaust grill 106 are removable from the system 100 to allow access to the interior of the system 100. Removal of the inlet grill 104 exposes the emitter electrodes 332 within the housing, thereby allowing the user to clean the emitter electrodes 332. In addition, removal of the exhaust grill 106 exposes the trailing electrodes 322, thereby allowing the user to clean the trailing electrodes 322. In one embodiment, the trailing electrodes 322 are coupled to an inner surface of the exhaust grill 106 (FIGS. 7 and 8). This arrangement allows the user to remove the trailing electrodes 322 from the housing 102 by simply removing the exhaust grill 106. In addition, the trailing electrodes 322 positioned along the inner surface of the exhaust grill 106 allow the user to easily clean the trailing electrodes 322 by simply removing the exhaust grill 106. Also, the positioning of the trailing electrodes 322 along the inner surface of the exhaust grill 106 permits the user to easily access and clean the interior of the housing 102, including the electrode assembly 320. Further, placement of the trailing electrodes 322 along the inner surface of the exhaust grill 106 allows the trailing electrodes 322 to emit ions directly out of the system 100 with the least amount of resistance. In another embodiment, the trailing electrodes 322 are mounted within the body 102 and are positioned to be freestanding such that the user is able to clean the trailing electrodes 322 upon removing the exhaust grill 106 as shown in FIG. 6. It is also contemplated that the freestanding trailing electrodes 322 are removable from the housing 102 to allow the user to clean the trailing electrodes 322.

The inlet grill 104 and the exhaust grill 106 are removable either partially or fully from the housing 102. In particular, as shown in the embodiment in FIG. 6, the exhaust grill 106 as well as the inlet grill 104 include several L-shaped coupling tabs 120 which secure the respective grills to the housing 102. The housing 102 includes a number of L-shaped receiving slots 122 which are positioned to correspondingly receive the L-shaped coupling tabs 120 of the respective grills. The inlet grill 104 and the exhaust grill 106 is alternatively removable from the housing 102 using alternative mechanisms. For instance, the grill 106 can be pivotably coupled to the housing 102, whereby the user is given access to the electrode assembly upon swinging open the grill 106. Alternatively, the inlet grill 104 and exhaust grill 106 are not removable from the housing 102.

FIG. 7 illustrates a perspective view of the inner surface of the removable exhaust grill 106 in accordance with one embodiment of the present invention. As shown in FIG. 6, the exhaust grill 106 includes a top end 436 and a bottom end 438. The top end 436 of the grill 106 is configured to be proximal to the top end 124 of the housing 102 and the bottom end 438 is configured to be proximal to the base 108 when coupled to the housing 102. In one embodiment, the inner surface of the exhaust grill 106 has a concave shape. In one embodiment, the exhaust grill 106 is substantially the same as the height of the elongated housing 102.

As discussed above, the trailing electrodes 322 are positioned downstream of the collector electrodes 342. In one embodiment, the trailing electrodes 322 are positioned downstream and adjacent to the collector electrodes 342. In another embodiment, the trailing electrodes 322 are positioned directly downstream and in-line with the collector electrodes 342.

In one embodiment, the trailing electrode wires 322 are held in place along the interior of the exhaust grill 106 by a number of coils 418, as shown in FIG. 7. Although not shown in the figures, the present invention also includes a set of coils 418 which are also positioned near the top 436 of the exhaust grill 106 which secures the electrodes to the interior of the grill 106. A conducting member 426 electrically connects the trailing electrodes 322 to the second HVS 172 when the exhaust grill 106 is coupled to the front of the body 102. Similarly, the conducting member 426 electrically disconnects the trailing electrodes 322 from the second HVS 172 when the exhaust grill 106 is removed from the front of the body 102. Therefore, the trailing electrodes 322 are not charged when removed from the housing 102 for cleaning. In one embodiment, the trailing electrodes 322 are held taut against the inside surface of the exhaust grill 106. Alternatively, the length of the wires 322 is longer than the distance between the coils 418 on opposite ends of the exhaust grill 106. Therefore, the trailing electrodes 322 are configured to be slackened against the inside surface of the exhaust grill 106. Although only three coils 418 and three trailing electrodes 322 are shown in FIG. 7, it is contemplated that any number of trailing electrode wires 322 can be alternatively used. It is contemplated that the trailing electrodes 322 are alternatively removable from the inner surface of the grill 106.

FIG. 8 illustrates one embodiment of the exhaust grill 106. The exhaust grill 106 includes several pegs 428 which protrude from the inner surface as shown in FIG. 8. In addition, the grill 106 is shown to include three trailing electrode wires 322. One end of each electrode wire 322 is attached to a conducting member 430 and the other end is attached to the furthest peg 428 from the conducting member 430. Each peg 428 includes an aperture which allows the trailing electrode wire 322 to extend therethrough, wherein the pegs 428 are positioned to hold the wires 322 along the inner surface of the grill 106. Although only three pegs 428 and three trailing electrode wires 322 are shown in FIG. 8, it contemplated that any number of pegs 428 and trailing electrode wires 322 can be alternatively used. It should also be noted that the trailing electrodes 322 coupled to the inner surface of the removable exhaust grill 106 are coupled to the independently controllable second HVS 172 in one embodiment or the first HVS 170 which operates the emitter and collector electrodes 330, 340 in another embodiment. It is contemplated that the trailing electrodes 322 are alternatively removable from the inner surface of the grill 106.

The operation of cleaning the present system 100 will now be discussed. In operation, the exhaust grill 106 is first removed from the housing 102. This is done by lifting the exhaust grill 106 vertically and then pulling the grill 106 laterally away from the housing 102. Additionally, the inlet grill 106 is removable from the housing 102. Once the exhaust grill 106 is removed from the housing 102, the trailing electrodes 322 is exposed, and the user is able to clean the trailing electrodes 322 on the interior of the grill 106 (FIGS. 7 and 8) or as a component in the housing (FIG. 6). With the inlet and exhaust grills 104, 106 removed, the collector electrodes 342 and emitter electrodes 322 (FIG. 5) are also exposed. In one embodiment, the user is able to clean the collector electrodes 342 while the electrodes 342 are positioned within the housing 102. Alternatively, or additionally, the user is able to pull the collector electrodes 342 telescopically out through an aperture 126 in the top end 124 of the housing 106 as shown in FIG. 6. The user is thereby able to completely remove the collector electrodes 342 from the housing 102 and have access to the collector electrodes 342 as well as the emitter electrodes 322.

Once the collector electrodes 342 are cleaned, the user is then able to insert the collector electrodes 340 back into the housing 102. In one embodiment, this is done by allowing the electrode set 340 to move vertically downwards through the aperture 126 in the top end 124 of the housing 102. The user is then able to couple the inlet grill 104 and the exhaust grill 106 to the housing 102 in an opposite manner from that discussed above. It is contemplated that the grills 104,106 are alternatively coupled to the housing 102 before the collector electrodes 342 are inserted. Also, it is apparent to one skilled in the art that the electrode set 340 is able to be removed from the housing 102 while the inlet and/or exhaust grill 104, 106 remains coupled to the housing 102.

The foregoing description of the above embodiments of the present invention has been provided for the purposes of illustration and description. It is not intended to be exhaustive or to limit the invention to the precise forms disclosed. Many modifications and variations will be apparent to one of ordinary skill in the relevant arts. The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the claims and their equivalence.

What is claimed is:

1. An air treatment device comprising:

a. a housing;

b. an electrode assembly within the housing; and c. a voltage source electrically connected to the electrode assembly, wherein the electrode assembly creates ions during normal operation and automatically creates an increased amount of ions during a start up period.

2. The device of claim 1, wherein the voltage source further comprises:

a. a first voltage source to provide a first voltage potential between an emitter electrode and a collector electrode of the electrode assembly during the normal operation; and b. a second voltage source to provide a second voltage potential between the emitter and collector electrodes during the start up period, wherein the second voltage potential is greater than the first voltage potential.

3. The device of claim 1 further comprising a controller to increase voltage output from the voltage source to the electrode assembly during the start up period, wherein the controller decreases voltage output from the voltage source thereafter.

4. The device of claim 1 wherein the electrode assembly generates a first airflow rate during normal operation and a second airflow rate during the start up period, wherein the second airflow rate is greater than the first airflow rate.

5. The device of claim 1 further comprising a controller coupled to the voltage source, the controller configured to selectively adjust at least one operating parameter during the initial start up period.

6. The device of claim 1 further comprising a controller coupled to the voltage source, the controller configured to selectively adjust at least one of a duty cycle, pulse width, frequency, and amplitude output to the electrode assembly during the start up period.

7. The device of claim 1 further comprising a controller configured to increase modulation of voltage pulses to the electrode assembly during the start up period.

8. An air treatment device comprising:

a. an emitter electrode;

b. a collector electrode downstream of the emitter electrode; and c. a voltage source coupled to the emitter and collector electrodes to produce a flow of air from the emitter electrode to the collector electrode, the voltage source configured to automatically produce a first flow of air during a start up period and a second flow of air after the start up period, wherein the first flow is greater than the second flow.

9. The device of claim 8, wherein the voltage source further comprises:

a. a first voltage source to provide a first voltage to at least one of the emitter and collector electrodes after the start up period; and b. a second voltage source to provide a second voltage to at least one of the emitter and collector electrodes during the start up period, wherein the second voltage is larger than the first voltage.

10. The device of claim 8 further comprising a controller to increase voltage output from the voltage source during the start up period, wherein the controller automatically decreases voltage output from the voltage source thereafter.

11. The device of claim 8, wherein the collector electrode is energized to achieve a greater collection efficiency during the start up period.

12. The device of claim 8 further comprising a controller coupled to the voltage source, the controller configured to selectively adjust at least one operating parameter during the initial start up period.

13. The device of claim 8 further comprising a controller coupled to the voltage source, the controller configured to selectively adjust at least one of a duty cycle, pulse width, frequency, and amplitude output to the electrode assembly during the initial start up period.

14. The device of claim 8 further comprising a controller configured to increases modulation of voltage pulses to the electrode assembly during the start up period.

15. An air treatment device comprising:

a. an emitter electrode;

b. a collector electrode downstream of the emitter electrode; and c. a voltage source to provide a first voltage potential between the emitter and collector electrodes;

d. a controller coupled to the voltage source, wherein the controller causes the voltage source to automatically provide a second voltage potential between the emitter and collector electrodes for a predetermined amount of time upon the device being turned on, the second voltage potential greater than the first voltage potential.

16. The device of claim 15, wherein the controller automatically decreases the second voltage potential to the first voltage potential upon the reaching the predetermined amount of time.

17. The device of claim 15, wherein the controller is configured to selectively adjust at least one operating parameter during the predetermined amount of time.

18. The device of claim 15, wherein the controller selectively adjusts at least one of a duty cycle, pulse width, frequency, and amplitude output to the electrode assembly during the predetermined amount of time.

19. The device of claim 15, wherein the controller increases modulation of voltage pulses to the emitter and collector electrodes during the predetermined amount of time.

20. The device of claim 15, wherein the device generates a first airflow rate during normal operation and a second airflow rate during the start up period, wherein the second airflow rate is greater than the first airflow rate.

* * * * *